US006840471B2

(12) United States Patent
Roozeboom et al.

(10) Patent No.: US 6,840,471 B2
(45) Date of Patent: Jan. 11, 2005

(54) ROTARY GRINDER APPARATUS AND METHOD

(75) Inventors: Keith Roozeboom, Pella, IA (US); Gary Verhoef, Pella, IA (US); Duane R. De Boef, New Sharon, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/138,807

(22) Filed: May 3, 2002

(65) Prior Publication Data

US 2002/0190148 A1 Dec. 19, 2002

Related U.S. Application Data

(63) Continuation-in-part of application No. 09/513,011, filed on Feb. 25, 2000, now Pat. No. 6,422,495.

(51) Int. Cl.[7] ..... B02C 13/28
(52) U.S. Cl. ..... 241/197; 241/294
(58) Field of Search ..... 241/197, 294

(56) References Cited

U.S. PATENT DOCUMENTS

| | | | |
|---|---|---|---|
| 20,282 A | 5/1858 | Mackerley | |
| 380,245 A | 3/1888 | Creager | |
| 750,329 A | 1/1904 | Windingstad | |
| 939,776 A | 11/1909 | Williams | |
| 939,777 A | 11/1909 | Williams | |
| 1,344,832 A | 6/1920 | Stubbs | |
| 1,565,842 A | 12/1925 | Aram | |
| 2,221,002 A | 11/1940 | Mankoff | |
| 2,557,865 A | 6/1951 | Emmanouilidis | |
| 3,380,672 A | 4/1968 | Weispfenning | |
| 3,580,517 A | 5/1971 | Ehrlich | |
| 3,650,484 A | 3/1972 | Kimble et al. | |
| 3,758,035 A | 9/1973 | Ushiku et al. | |
| 4,033,515 A | 7/1977 | Barcell et al. | |
| 4,056,232 A | 11/1977 | Linnerz et al. | |
| 4,066,216 A | 1/1978 | Waldrop et al. | |
| 4,076,177 A | 2/1978 | Hirayama et al. | |
| 4,114,817 A | 9/1978 | Harris | |
| 5,419,502 A | 5/1995 | Morey | |
| 5,967,436 A | 10/1999 | Balvanz | |
| 5,971,305 A | 10/1999 | Davenport | |
| 6,042,035 A | 3/2000 | Grobler et al. | |
| 6,079,649 A | 6/2000 | Balvanz et al. | |
| 6,131,838 A | 10/2000 | Balvanz et al. | |
| 6,142,400 A | 11/2000 | Balvanz et al. | |
| 6,308,905 B1 | 10/2001 | Balvanz et al. | |
| 6,311,910 B1 | 11/2001 | Balvanz et al. | |
| 6,422,495 B1 * | 7/2002 | De Boef et al. | 241/197 |

FOREIGN PATENT DOCUMENTS

| | | |
|---|---|---|
| DE | 1 074 951 | 2/1960 |
| DE | 3211648 A1 | 10/1983 |
| EP | 1 201 310 A1 | 5/2002 |

OTHER PUBLICATIONS

Mailer entitled "United States Patent on Production Plus Hammers" *The Daily Grind, a publication of U.S. Manufacturing, Inc.*, vol. 4, Issue 11, 4 pgs. (Nov. 1999).

* cited by examiner

*Primary Examiner*—Mark Rosenbaum
(74) *Attorney, Agent, or Firm*—Merchant & Gould P.C.

(57) ABSTRACT

A rotary grinder having a cylindrical drum that includes a cylindrical surface. The cylindrical surface defines two holes. The drum receives opposite ends of a through-member at the two holes such that the opposite ends of the through-member comprise hammers when the cylindrical drum is rotated. A single retaining member is used to secure all of the through-members to the drum.

11 Claims, 25 Drawing Sheets

ROTARY GRINDER APPARATUS AND METHOD

CROSS REFERENCE TO RELATED APPLICATIONS

The present application is a continuation-in-part of U.S. patent application Ser. No. 09/513,011 filed Feb. 25, 2000, now issued as U.S. Pat. No. 6,422,495.

FIELD OF THE INVENTION

The present invention relates generally to rotary grinders used for grinding things such as waste materials. More particularly, the present invention relates to rotary grinders having rotating arrangements of hammers.

BACKGROUND OF THE INVENTION

Grinders for grinding waste material such as trees, brush, stumps, pallets, railroad ties, peat moss, paper, wet organic materials and the like are well known. An example of one such prior art grinder, known as a tub grinder, is shown in commonly assigned U.S. Pat. No. 5,507,441 dated Apr. 16, 1996. Another example is shown in U.S. Pat. No. 5,419,502 dated May 30, 1995. Another type of grinder is known as a horizontal grinder, examples can be found disclosed in U.S. Pat. Nos. 5,975,443, 5,947,395, 6,299,082.

There are 4 different types of grinders that can be identified as defined in U.S. Pat. No. 6,299,082 including chippers, hammer mills, hogs and shredders: Each including a type of a rotary grinding device.

Tub grinders typically include a rotary grinding devices such as a hammermill or hog that is mounted on a frame for rotation about a horizontal axis. The hammermill or hog function in cooperation with a shear bar or anvil and typically a screen; the assembly including the hammermill or hog, anvil and screen forming a grinding device. A rotating tub surrounds the grinding device. The tub rotates about a generally vertical axis. Debris is deposited in the rotating tub and the grinding device grinds the debris.

FIG. 1 illustrates one type of prior art hammermill 20 commonly used with conventional tub grinders. The hammermill 20 includes a plurality of hammers 22 secured to a plurality of rotor plates 24. The rotor plates 24 are rotatably driven about a generally horizontal axis of rotation 26. Cutters 25 (e.g., cutter blocks, cutter teeth, etc.) are mounted on the hammers 22 (e.g., with nuts 30 and bolts 28). The hammers 22 are secured between the rotor plates 24 by shafts or rods 31 aligned generally parallel to the horizontal axis of rotation 26. For example, each hammer defines two holes 32 and 34 each positioned to receive a different shaft 31 (only one shown). Shims 36 are mounted between the hammers 22 and the rotor plates 24. When the rotor plates 24 are rotated about the axis of rotation 26, the hammers 22 are carried by the rotor plates 24 in a generally circular path. Material desired to be ground is fed into the circular path such that the material is impacted and reduced in size by the cutters 25 of the hammers 22. The grinding device of a conventional tub grinder also typically includes a sizing screen that curves along a lower half of the hammermill. FIG. 15 illustrates a grinding device typical of the prior art including a rotary grinder 20, anvil 100 and screen 102. In this particular embodiment the screen 102 is comprised of 2 portions to aid removal and replacement. They are made to be replaceable, as different screens are installed to achieve differing ground material sizes.

The screens 102 are supported in alignment with the rotary grinder by plates 104 that are located on the sides of opening 45 in the floor 44 corresponding to the ends of the rotary grinder 20, and in the vicinity of the rotary grinder support bearings. They are supported by frame 48. Anvil 100 is supported by the frame 48 and by the screen 102. The screens 102 are available in the prior art in a variety of configurations. One variety include round holes, another includes square or rectangular holes. The size of the holes varies, and effects the maximum size material that is allowed to pass through. Other variations of the screens include varying circumferential coverage wherein the length of screen is reduced, thereby increasing the gap 106 between the screens. It is known to significantly increase the gap 106 to allow material to exit the grinding device to reduce drag and power requirements. This is typically done in applications wherein the size of the ground material is not critical.

A grinding chamber is formed between the screen and the hammermill. The screen performs a sizing function and defines a plurality of openings having a predetermined size. In use, material desired to be ground is repeatedly impacted by the hammers 22 against the screen, or crushed between the hammers 22 and the screen, causing the material to be reduced in size. When the material is reduced to a size smaller than the predetermined size of the openings defined by the screen, the material moves radially through the screen. Upon passing through the screen, the reduced material commonly falls by gravity to a discharge system located beneath the hammermill 20.

The grinding device of a horizontal grinder typically includes an anvil and a screen. Many different configurations for horizontal grinders have been developed, but the basic grinding actions are similar to those found in tub grinders.

The typical prior art hammermills or hogs generally utilize block-shaped cutters mounted such that the effective cutting edge is parallel to the axis of rotation. This results in a surface of rotation for each cutter describing a cylinder, having a single effective cutting diameter that cooperates with the straight edge of the anvil.

Many other techniques have been developed to improve the cutting efficiency including U.S. Pat. No. 4,066,216 disclosing relatively narrow cutters with plates that project into the space between cutters and U.S. Pat. No. 3,580,517 disclosing sharp-pointed cutters with an anvil that matched the profile of the surface of rotation defined by the cutters. In both of these examples the cutters are not as robust as a standard block-type cutter, resulting in concerns related to durability. Hammer wear is a significant concern relating to hammermills. For example, hammer wear results in loss of hammer integrity, out-of-balance conditions, reductions in grinding efficiency, and increases in maintenance and service costs. With a conventional hammermill, it is difficult to replace the hammers because the hammermill must be disassembled. Disassembling a hammermill can be particularly labor intensive and time consuming because the rods used to connect the hammers to the hammermill are quite heavy. There are typically several rods per hammermill and frequently two rods must be removed to replace a single hammer. Furthermore, rods can be corroded in place or deformed thereby making it even more time consuming and costly to disassemble a hammermill.

Power requirements and resulting fuel consumption is also affected by the interaction of the screens and the hammers. The crushing characteristic is known to result in a significant amount of frictional drag. This drag results from to the tendency to trap the material between the stationary screen surface and the moving cutters or hammers while under significant load. This condition results in either the material moving with the cutters and sliding against the screen or the material being retained by the screen and the cutters sliding past the material or some combination. Any of these result in significant drag, thus grinders typically require significant power.

SUMMARY OF THE INVENTION

One aspect of the present invention relates to a rotary grinder having a cylindrical drum rotatable about its axis. The cylindrical drum has a cylindrical wall, a first end and a second end. The cylindrical wall defines a first receiving hole and a second receiving hole for receiving opposite ends of a through-member. The first end of the through-member extends to the outside of the cylindrical wall by passing through the first receiving hole such that the first end of the through-member comprises a first grinding portion (e.g., a hammer, cutter, blade, tooth, etc.) when the cylindrical drum is rotated. Likewise, the second end of the through-member extends to the outside of the cylindrical wall by passing through the second receiving hole such that the second end of the through-member comprises a second grinding portion (e.g., a hammer, cutter, blade, tooth, etc.) when the cylindrical drum is rotated. Thus, the through-member forms a duplex grinding member (e.g., a duplex hammer).

Another aspect of the present invention relates to a rotary grinder having a plurality of grinding members secured to a drum by a single retaining member that extends longitudinally through the drum.

Another aspect of the present invention relates to a replaceable through-member adapted for use with a rotary grinder in accordance with the principles of the present invention. A further aspect of the invention relates to a method of securing a grinding member to a hollow drum by using a longitudinal retaining member.

In accordance with another aspect of the invention, a method for replacing a drum in a rotary grinder is presented. The rotary grinder includes a rotatable drum having a first end and a second end and a cylindrical surface. The rotary grinder also includes a plurality of hammers attached to the cylindrical surface and a first end cap attached to the first end of the drum and a second end cap attached to the second end of the drum. The method comprises the steps of removing the first end cap from the rotatable drum; removing the second end cap from the rotatable drum; replacing the rotatable drum with a second rotatable drum; attaching the first end cap to the first end of the second rotatable drum; and attaching the second end cap to the second end of the second rotatable drum.

Another aspect of the present invention relates to a grinding device which includes a novel screen that works in conjunction with the rotary grinder to improve the efficiency of the grinding process to require less power and fuel.

Another aspect of this invention is a grinding device that includes the novel screen and rotary grinder to improve the grinding efficiency and thus to achieve improved ground material size consistency.

Another aspect of this invention is a novel screen adaptable to several types of cylindrical drums to improve the grinding efficiency A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
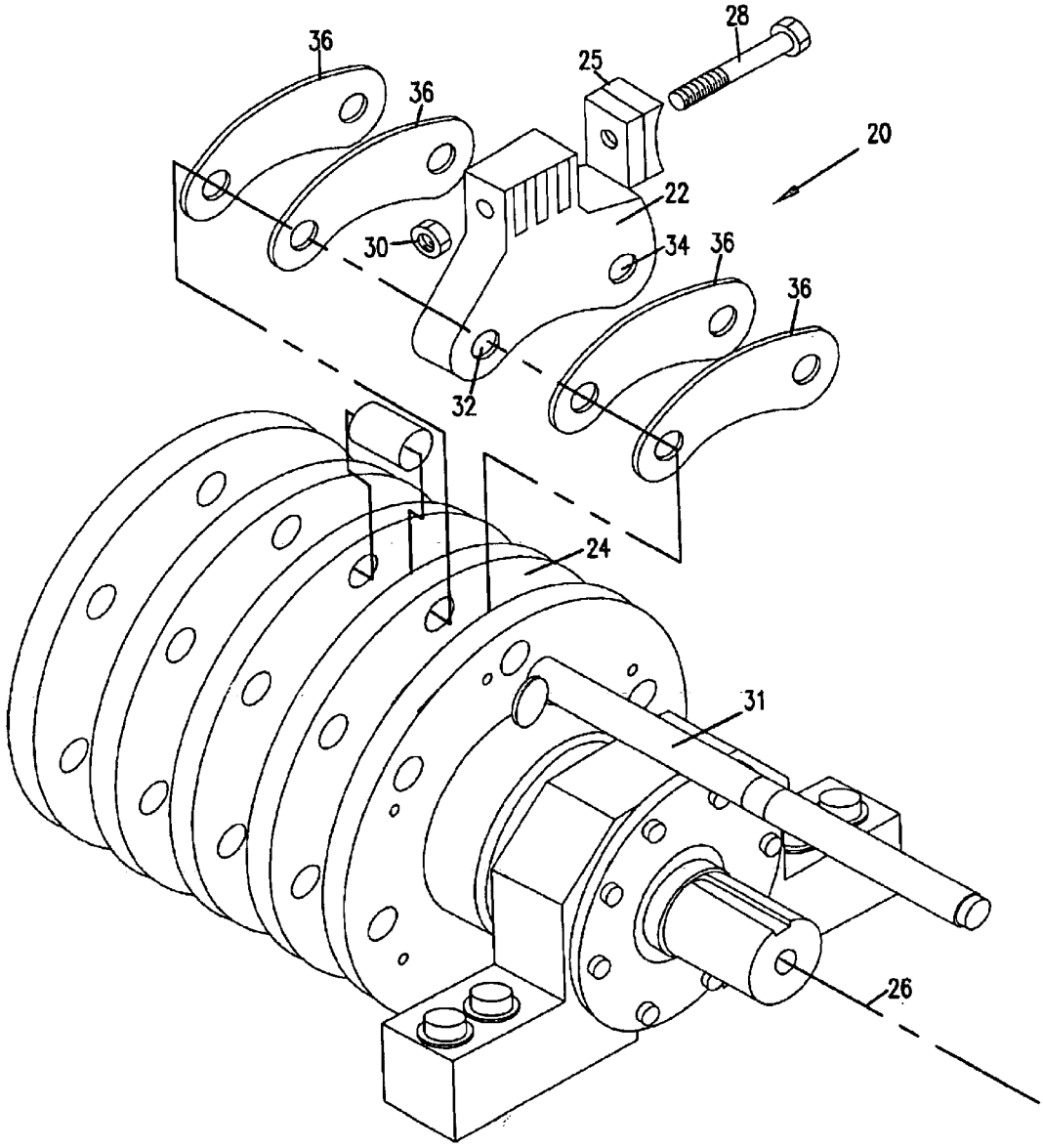
FIG. 1 (Prior Art)
FIG. 1 is a perspective view of a prior art hammermill assembly.
Figure 2:
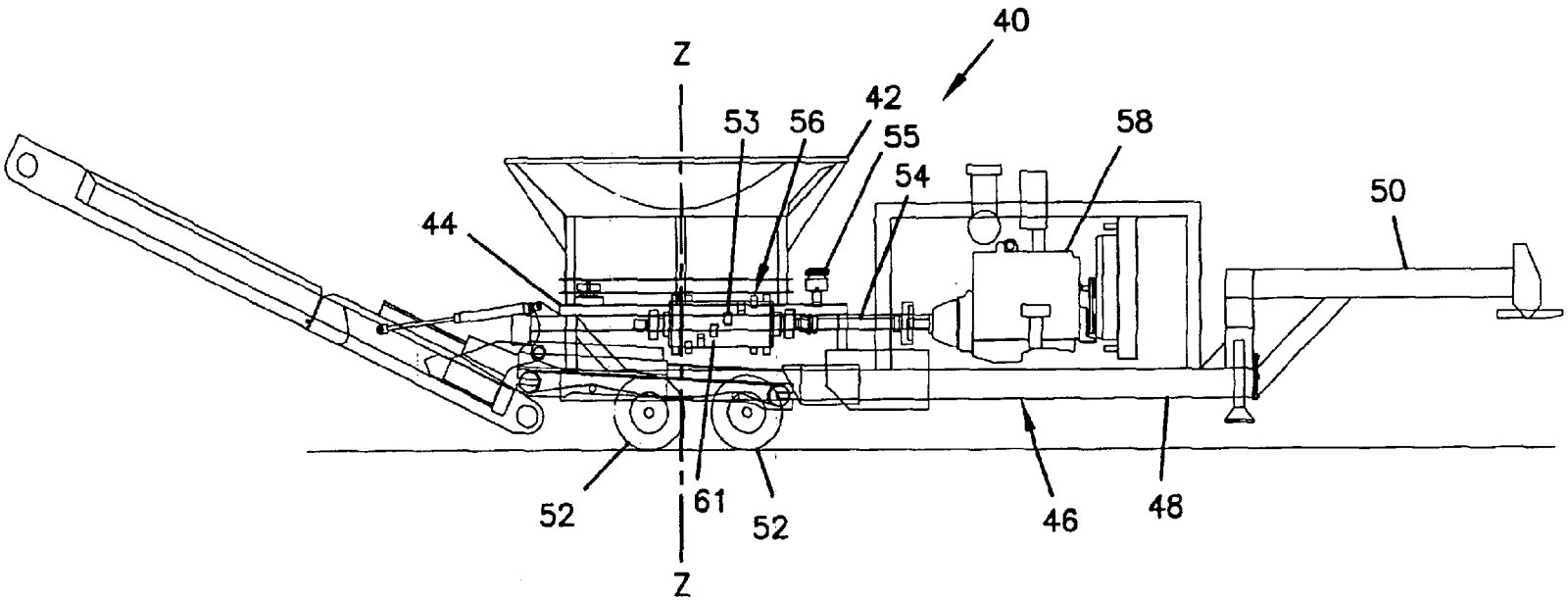
FIG. 2 is a schematic illustration of a tub grinder incorporating aspects of the invention.
Figure 3:
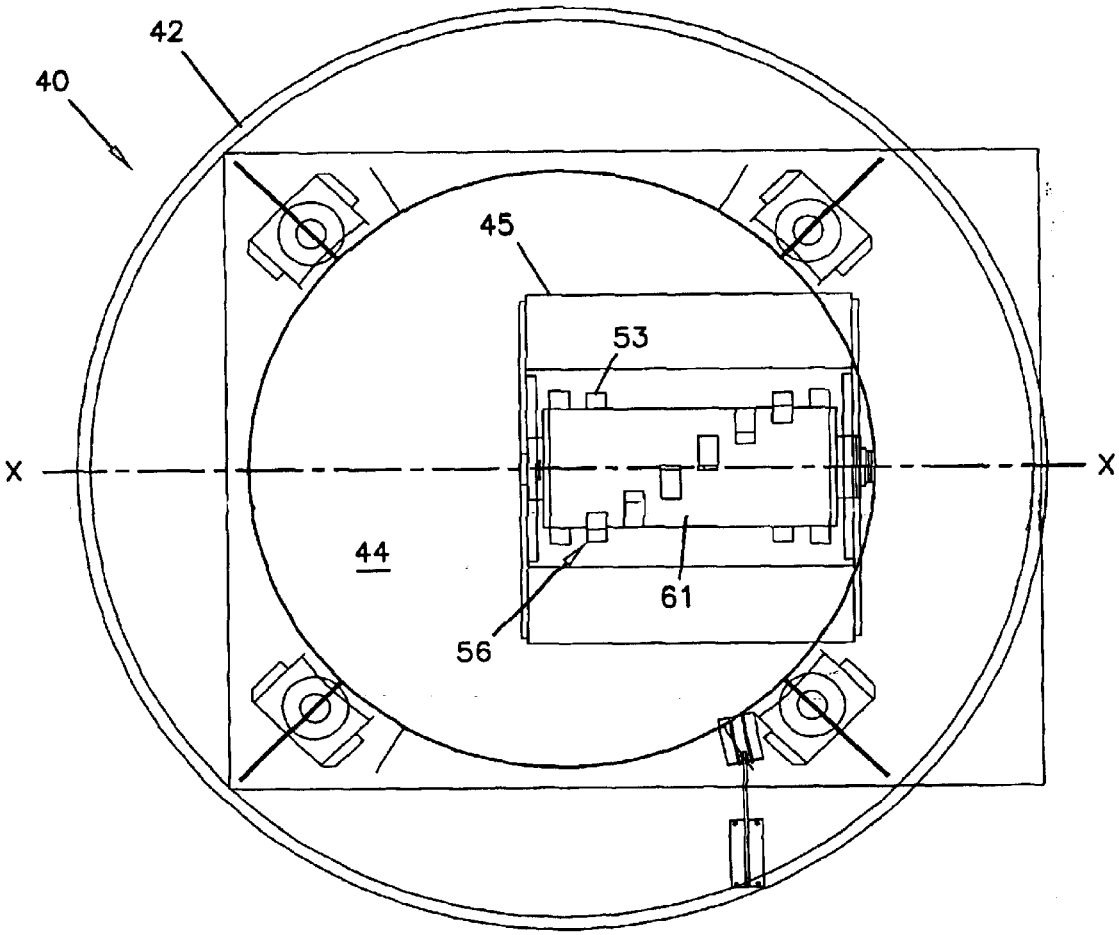
FIG. 3 is a top view of the tub grinder of FIG. 2.

Referring to FIGS. 2 and 3, a tub grinder 40 is shown. The tub grinder 40 is being shown exclusively to provide an illustrative field or environment to which the various aspects of the present invention are applicable. It will be appreciated that the tub grinder 40 is but one example of a type of grinding machine to which the various aspects of the present invention can be applied, and is not intended to in any way limit the scope of the present invention.

The tub grinder of FIGS. 2 and 3 includes a rotary tub 42 mounted above a horizontal floor 44 for rotation about a vertical axis z—z. The floor 44 and the tub 42 are secured to a frame 48 of a trailer 46. The frame 48 includes a hitch 50 for attachment to a semi-tractor for towing the tub grinder 40. Wheels 52 are mounted on the frame 48. A rotary grinder member or hammermill 56 is secured to the frame 48 beneath the tub 42.

As best illustrated in FIG. 3, the floor 44 includes a floor opening 45 for allowing an upper portion of the hammermill 56 to extend into the tub 42. In the remainder of this disclosure the term hammermill is meant to be synonymous with hog or rotary grinder. The hammermill 56 is mounted for rotation about a horizontal axis x—x and includes a plurality of hammers 53 (shown schematically in FIGS. 2 and 3) that engage and crush waste material deposited in the tub 42. The hammers 53 are secured to a drum 61 of the hammermill 56 as described below.

The hammermill 56 is coupled via a shaft 54 to an engine 58 for rotating the hammermill 56. In operation, the tub 42 is rotated about the vertical axis z—z by a motor 55 (shown in FIG. 2). Simultaneously, the hammermill 56 is rotated about the horizontal axis x—x.

Figure 4A:
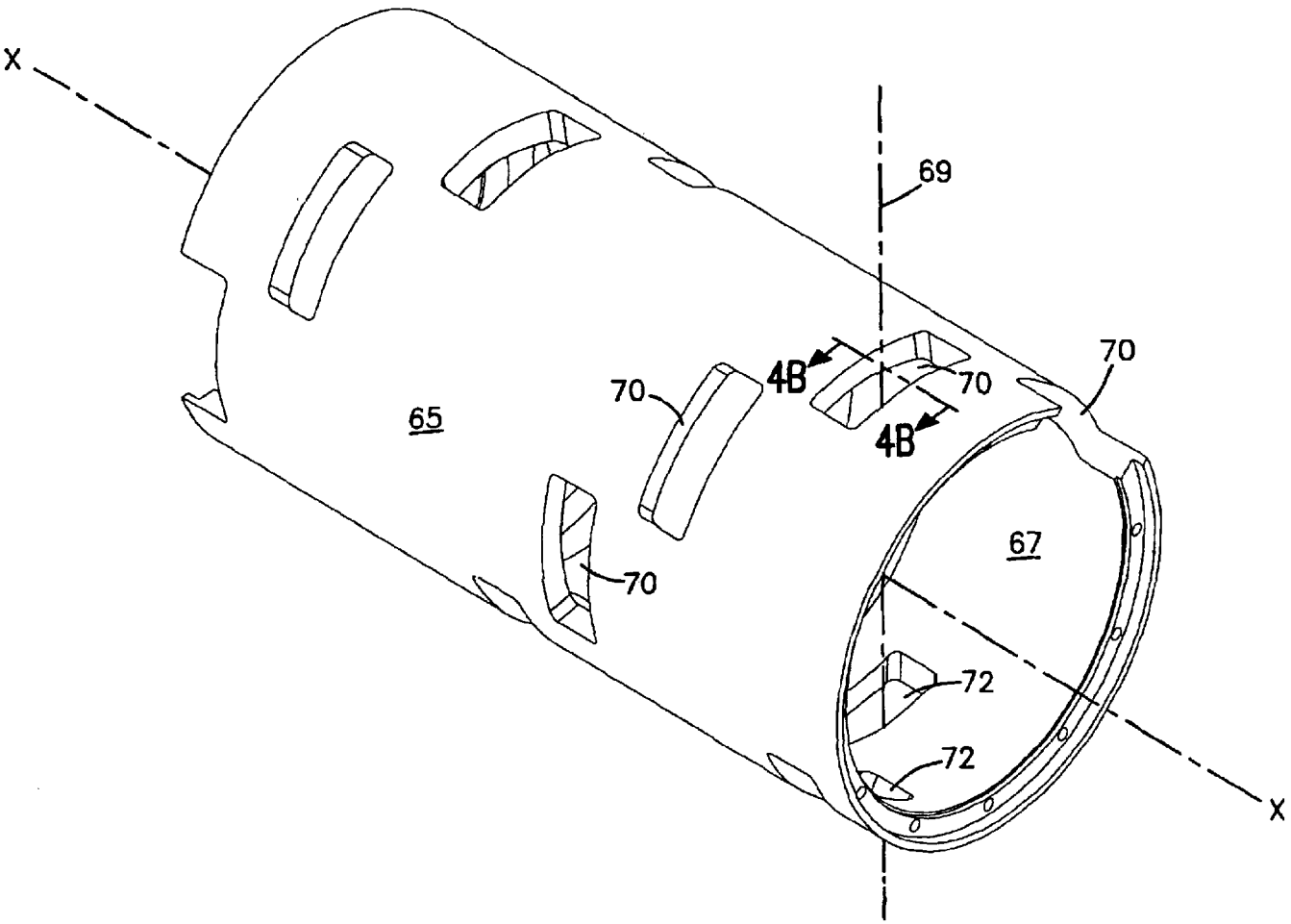
FIG. 4*a* is a perspective view of a cylindrical drum of one embodiment of the invention.

FIG. 4*a* shows the cylindrical drum 61 of the hammermill 56. The cylindrical drum 61 is hollow and includes a cylindrical wall having a cylindrical exterior surface 65 and a cylindrical interior surface 67. The cylindrical drum 61 defines a plurality of holes 70 arranged in a pattern that spirals around the cylindrical surface of the drum 61. Each hole 70 has a corresponding hole 72 positioned on the opposite side of the drum 61 from the hole 70. The holes 70, 72 extend through the drum 61 in a radial direction between the interior and exterior surfaces 65 and 67. Preferably, the holes 70, 72 are positioned such that straight lines 69 drawn from the holes 70 to their corresponding holes 72 pass through the horizontal axis x—x of the drum 61. In the depicted embodiments, the holes 70 are axially staggered or offset relative to their corresponding holes 72 such that the straight lines 69 extending between the holes 70, 72 intersect the horizontal axis x—x at an oblique angle θ (shown in FIG. 4*b*). In certain non-limiting embodiments, oblique angle θ is in the range of 80–90 degrees, or about 83 degrees. Preferably, the angle is selected such that cutters/grinders mounted adjacent the holes define separate cutting paths. Thus, the angle selected is typically at least partially dependent of the diameter of the drum 61. Of course, the angle θ need not be limited to oblique configurations, and could also be perpendicular.

Figure 4B:
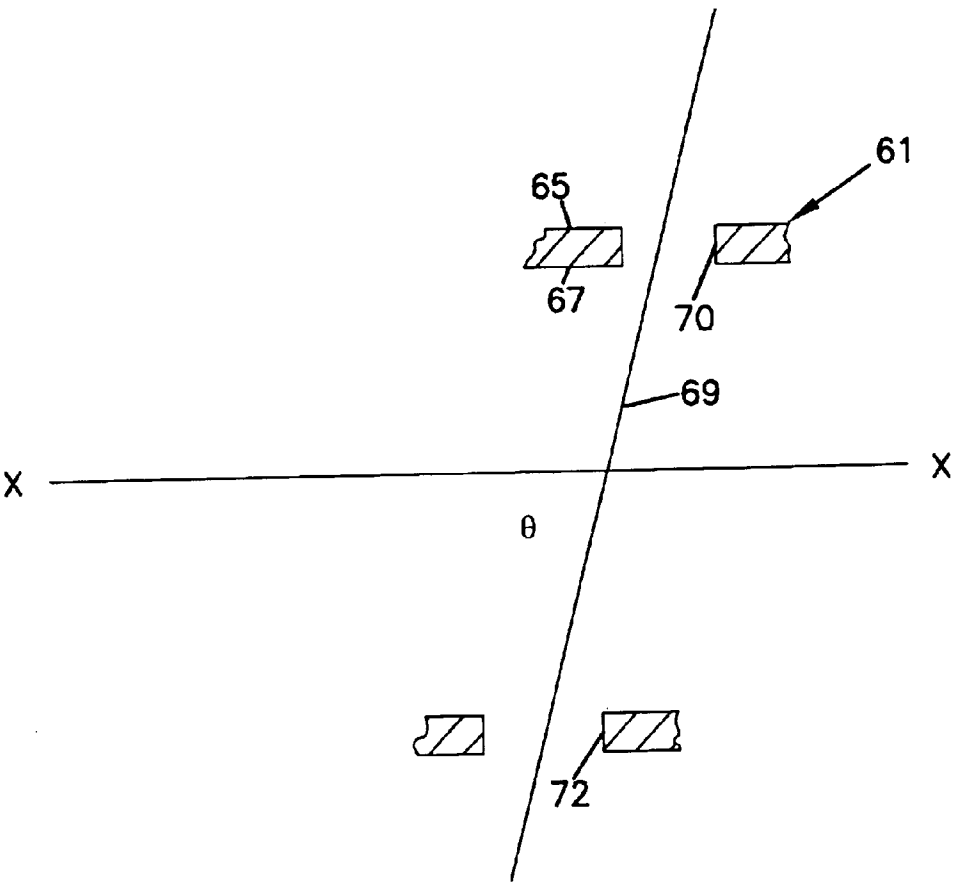
FIG. 4*b* is a cross-sectional view of the drum of FIG. 4*a* taken along section lines 4*b*–4*b;*
Figure 4C:
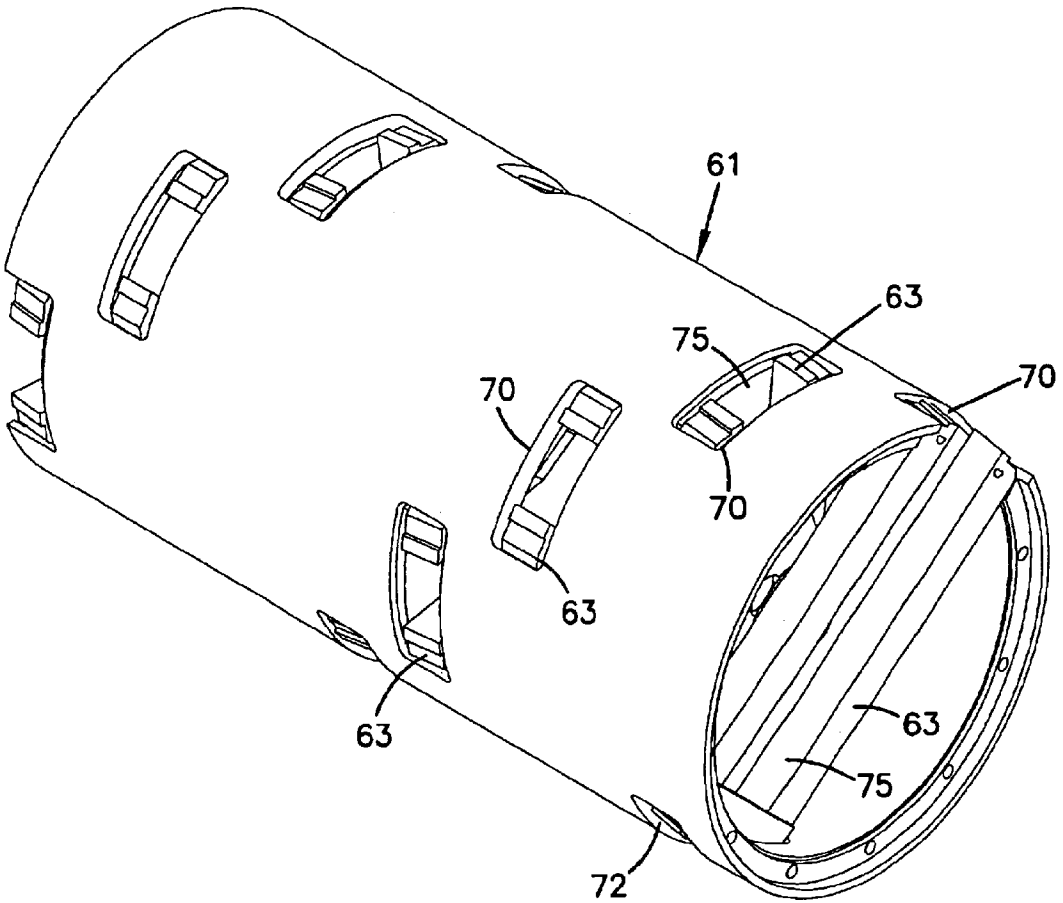
FIG. 4*c* is a perspective view of the drum of FIG. 4*a* with mounting sleeves mounted therein.

FIG. 4*c* shows the drum 61 with sleeves 63 that extend radially between the holes 70, 72. The sleeves 63 extend radially through the interior of the drum 61 and are preferably welded in place. Each sleeve 63 defines a channel 75 that extends from one of the holes 70 to a corresponding hole 72.

The shape of the holes 70, 72 in the embodiment shown in FIG. 4*a* is rectangular. However, the scope of this invention is not limited to holes 70 and 72 having a rectangular shape. For example, the holes 70 and 72 could be circles, ovals, triangles or any other shape.

Figure 5A:
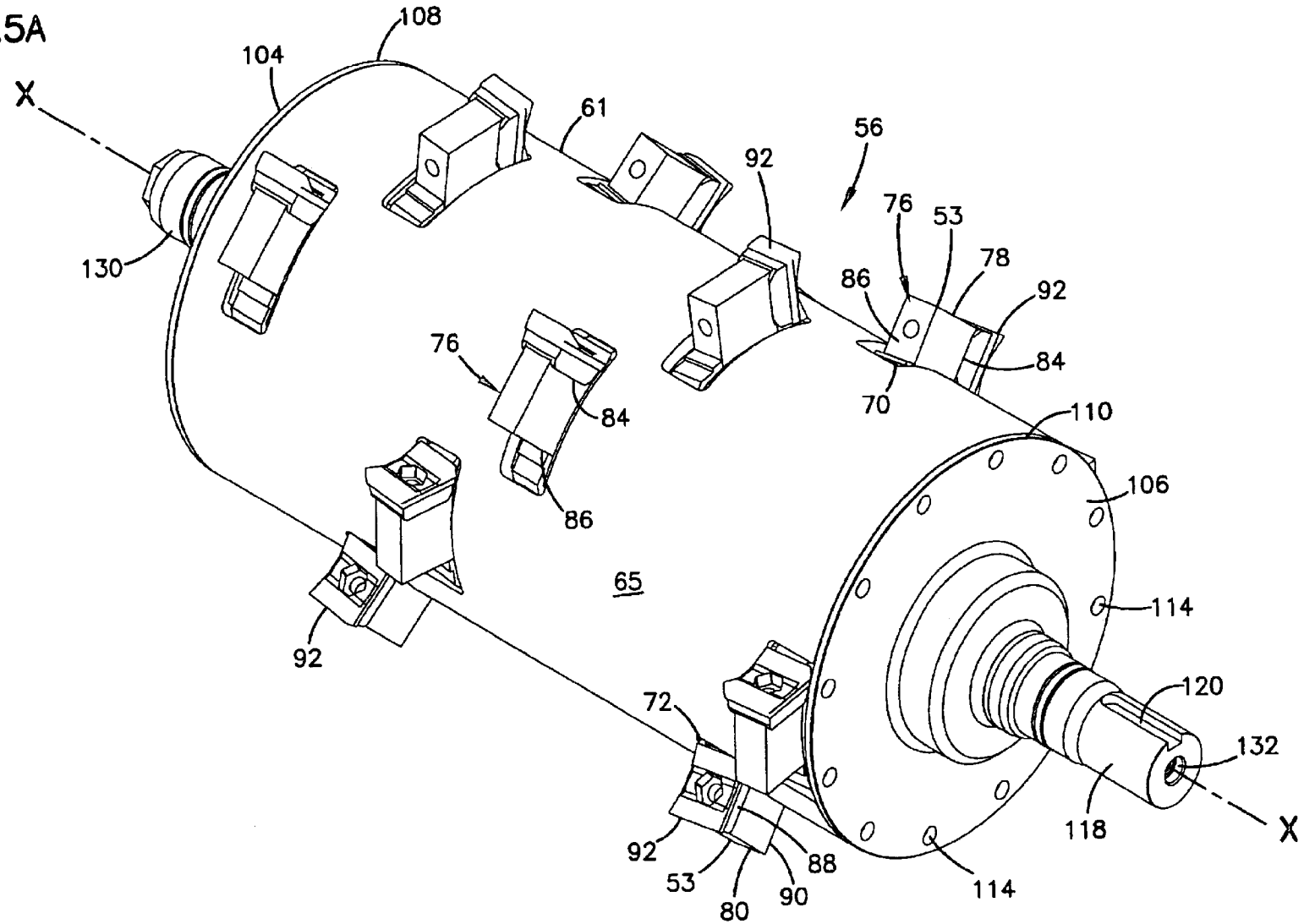
FIG. 5*a* is a perspective view of one embodiment of a hammermill of the invention.
Figure 5B:
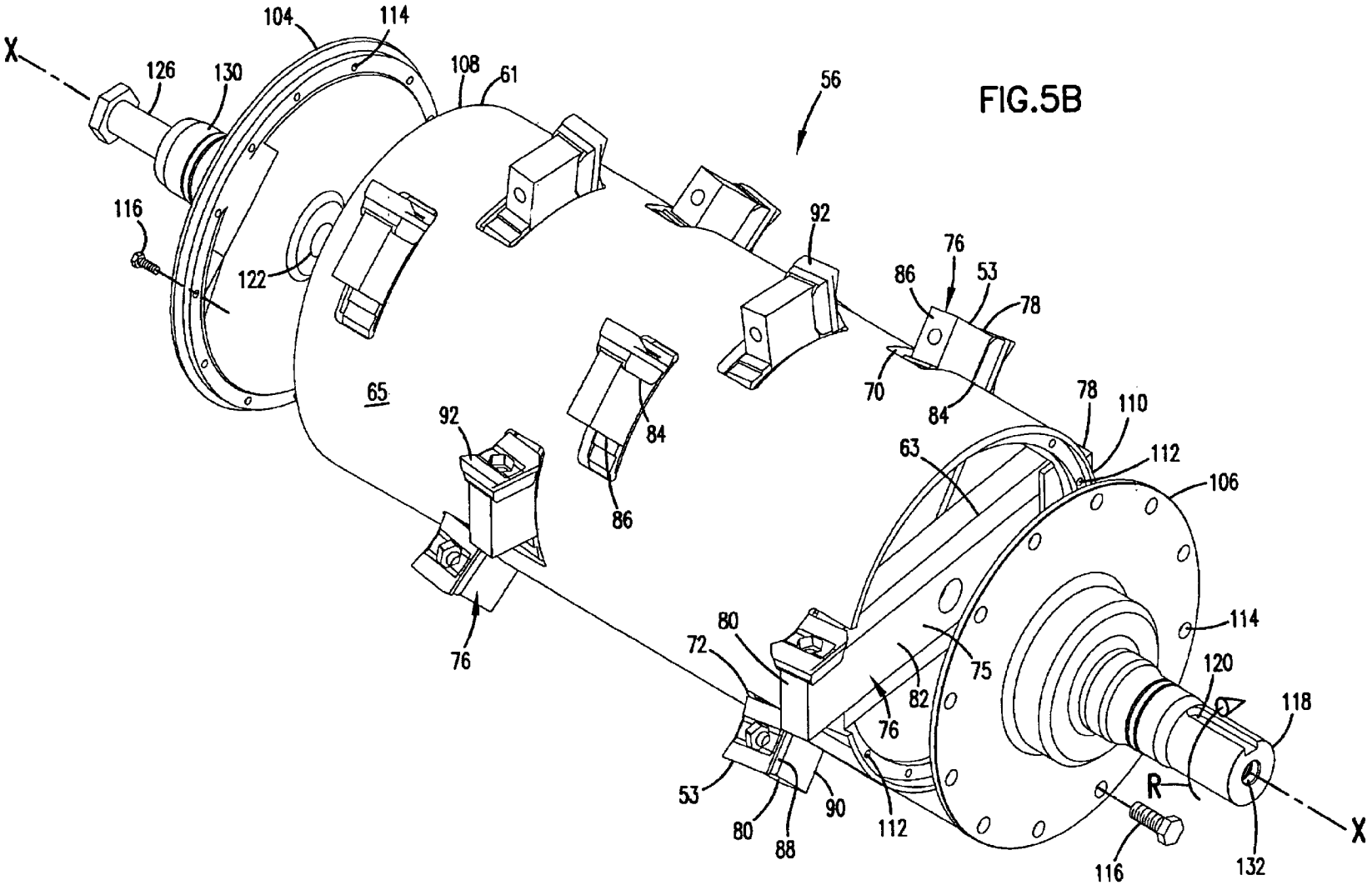
FIG. 5*b* is a partially exploded, perspective view of the hammermill of FIG. 5*a;*

FIG. 5*a* shows the hammermill 56 in isolation from the tub grinder 40. The drum 61 of the hammermill 56 includes oppositely positioned first and second ends 108 and 110 that are respectively closed or covered by first and second end caps 104 and 106. As best shown in FIG. 5*b*, the first and second ends 108,110 have threaded holes 112 that align with corresponding holes 114 in the first and second end caps 104,106. The end caps 104, 106 are preferably removably connected to the drum 61. For example, bolts 116 can be used to removably secure the end caps 104, 106 to the drum 61 by inserting the bolts through the holes 114 and then threading the bolts 116 into the openings 112. The removability of the end caps 104, 106 is advantageous because the drum 61, which has a greater tendency to wear than the end caps, can be replaced without requiring the end caps 104, 106 to be replaced at the same time. This also allows the drum 61 to be reversed (rotated end-to-end relative to the end caps 104, 106) to increase the useful life of the drum 61.

As described above, the end caps 104, 106 are connected to the drum 61 by fasteners 116. It will be appreciated that this is but one fastening technique that could be used. Other techniques include, among other things, providing mating threads on the end caps and the drum such that the end caps can be threaded onto or into the drum. Alternatively, a snap-ring configuration, as well as other configurations, could also be used to secure the end caps 104, 106 to the drum 61.

A driven shaft 118 is provided on the second end cap 106, and a non-driven shaft 130 is provided on the first end cap 104. The shafts 118, 130 are preferably connected to their respective end caps 106, 104 by conventional techniques (e.g., the shafts 118, 130 can be welded to or forged as a single piece with their respective end caps 106, 104). The shafts 118, 130 are aligned along the axis of rotation x—x of the hammermill 56 and project axially outward from their respective end caps 106, 104. The driven shaft 118 defines a keyway 120 or other type of structure (e.g., splines) for use in coupling the driven shaft 118 to the drive shaft 54 of the engine 58. In this manner, engine torque for rotating the hammermill 56 can be transferred to the hammermill 56 through the driven shaft 118. When mounted within the tub grinder 40, the shafts 118, 130 are preferably supported in conventional bearings adapted for allowing the hammermill 56 freely rotate about the axis of rotation x—x.

Referring to FIGS. 5*a* and 5*b*, the hammermill 56 also includes a plurality of through-members 76 (e.g., bars) that extend radially through the drum 61 and include ends that project radially beyond the exterior surface 65 of the drum 61. Each of the through-members 76 forms two hammers 53 positioned on opposite sides of the drum 61. Hence, the through-members 76 can be referred to as "duplex hammers." The particular embodiment shown in FIGS. 5*a* and 5*b* includes eight through-members 76 that provide a total of sixteen hammers. However, any number of through-members 76 could be used.

As best shown in FIG. 5*b*, the through-members 76 each have a first end 78, a second end 80 and a central portion 82. The central portions 82 are situated in the interior of the cylindrical drum 61. Each through-member 76 extends through one of the holes 70 of the drum 61, and also through the corresponding opposite hole 72 of the drum 61. Within the drum 61, the through-members 76 extend through the channels 75 defined by the sleeves 63. The holes 70, 72 allow the first and second ends 78, 80 to be situated outside the exterior of the cylindrical drum 61 so as to form exterior hammers. Each through-member 76 has a leading face 84 and a trailing face 86 on the first end 78, and a leading face 88 and trailing face 90 on the second end 80. The leading faces 84 and 88 and the trailing faces 86 and 90 extend radially outward beyond the exterior surface 65 of the drum 61. The leading faces 84 and 88 are the surfaces that lead the through-member 76 as it rotates in a direction designated as R in FIG. 5*b*.

The leading faces will be subjected to the grinding loads and friction which will result in the through-member being subjected to an overhanging load situation and wear. The loading situation will have the tendency to deflect the through-member and has been seen to permanently deform the through-member. In certain cases the through-member is first deflected and later can fail, be broken. In that case the through-member can be difficult to remove. It has been found that manufacturing the through members from steel conforming to specifications SAE 4140 through-hardened to a minimum exterior surface harness of Rockwell C-Scale Hardness 32 provides a much improved performance. The resulting through-member has a higher yield point, than prior to being through-hardened, and experiences less permanent deflection prior to failure. Thus, if failure occurs, it has not been preceded by deformation, and subsequent removal is improved. Other specific manufacturing processes could be utilized. The design intent is for the through member to withstand normal loading without any permanent deflection, without exceeding its yield point and for the through-member to intentionally fail when its yield point is exceeded. This can be affected by the proper material and heat treatment as herein disclosed, and is also affected by the geometry of the through-member. For instance a stress concentration groove or undercut could be intentionally located to achieve this result.

In addition to the bending affect, the through-members are subjected to significant wear. The preferred embodiment of through hardening the through-members to an exterior hardness of Rockwell C-Scale Hardness 32 minimum also significantly improves the wear characteristics. Here again other material specifications could be utilized to achieve this result, such as utilization of a low carbon steel with a type of surface hardening such as carburization. However, this type of material would provide significantly different bending failure characteristics. Thus, the material and heat treatment is selected to provide improved bending characteristics combined with improved wear characteristics.

Figure 5C:
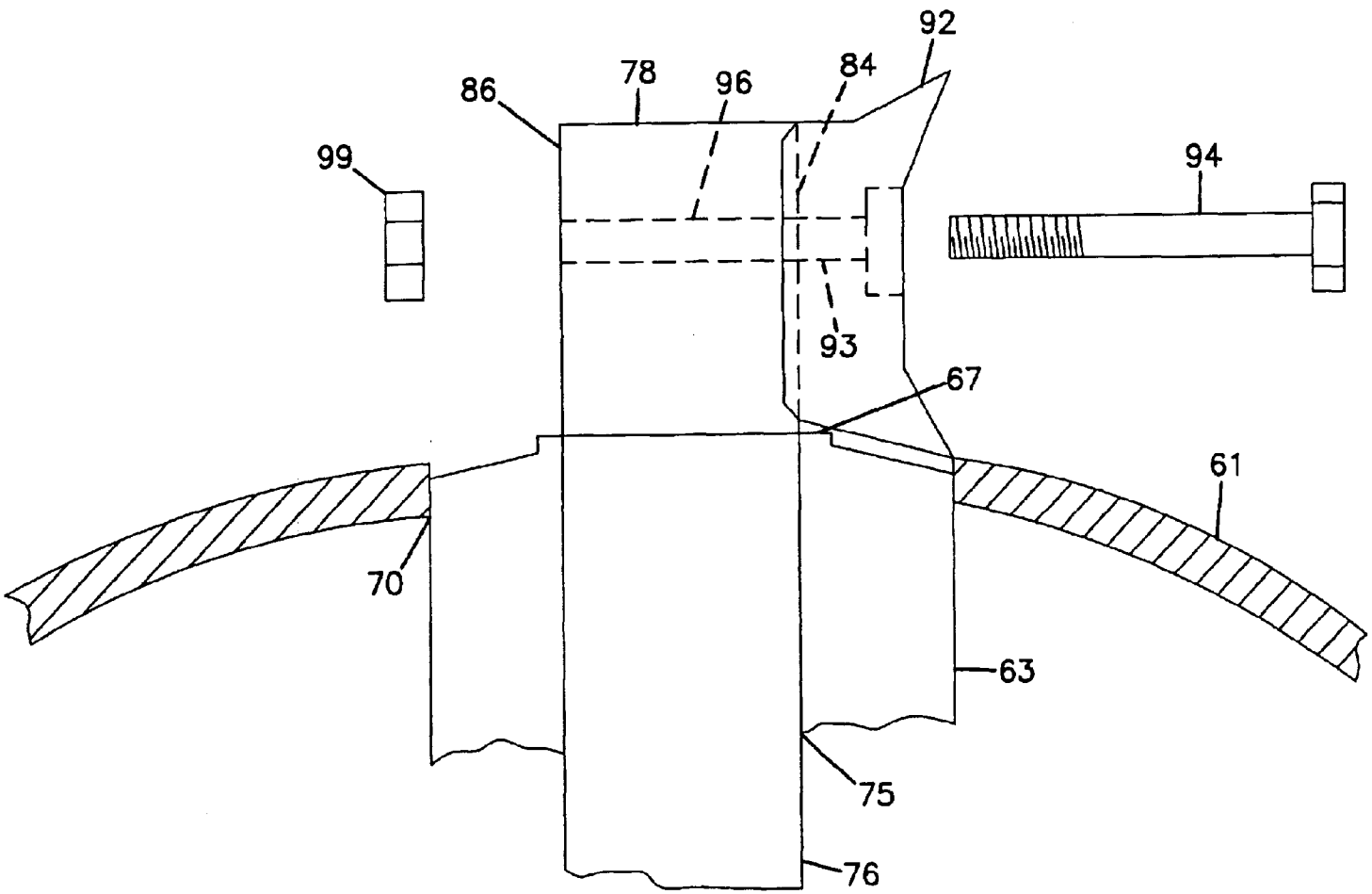
FIG. 5*c* is a side view of a connection configuration for securing a cutter to one of the hammers of the hammermill of FIGS. 5*a*–5*b;*

A cutter 92 is preferably attached to each of the leading faces 84 and 88 of the through-members 76. FIG. 5*c* shows one of the cutters 92 adapted to be attached to one of the leading faces 84. A bolt 94 is adapted to pass through co-axially aligned holes 93, 96 respectively defined by the cutter 92, and the through-member 76. By inserting the bolt 94 through the openings 93, 96 and threading a nut 99 on the bolt 94, the cutter 92 is securely clamped against the through-member 76. It will be appreciated that the cutter 92 can be any type of cutter known in the art with the preferred form of cutter being dictated by the type of grinding to be performed as is well known in the art. In the preferred embodiment illustrated the cutter 92 is symmetrical, including 2 cutting edges. The effective cutting edge is located on the outside, at the extreme radial dimension of the assembly, defining the cutting diameter. In that position there is a second cutting edge on the opposite end of the cutter, that is located below the outside surface 65 of the drum 61. In this manner the second cutting surface is protected by the outside surface 65.

When the cutter 92 is clamped to the through-member 76 as shown in FIG. 5*c*, the cutter 92 opposes or engages a retaining shoulder 67 formed at the end of the sleeve 63. In this manner, the cutter 92 fastener is protected from shear loads by transferring forces through the sleeve 63 to the drum 61. Similar cutters 92 and retaining shoulders 67 are located at each end of each through-member 78. Engagement between the cutters 92 and the shoulders 67 functions to center or align the through-members 78 such that central openings 125 of the through-members 78 align with the axis of rotation x—x of the hammermill 56. The sleeves 63 also function to guide the through-members 76 through the openings 70, 72.

Figure 10:
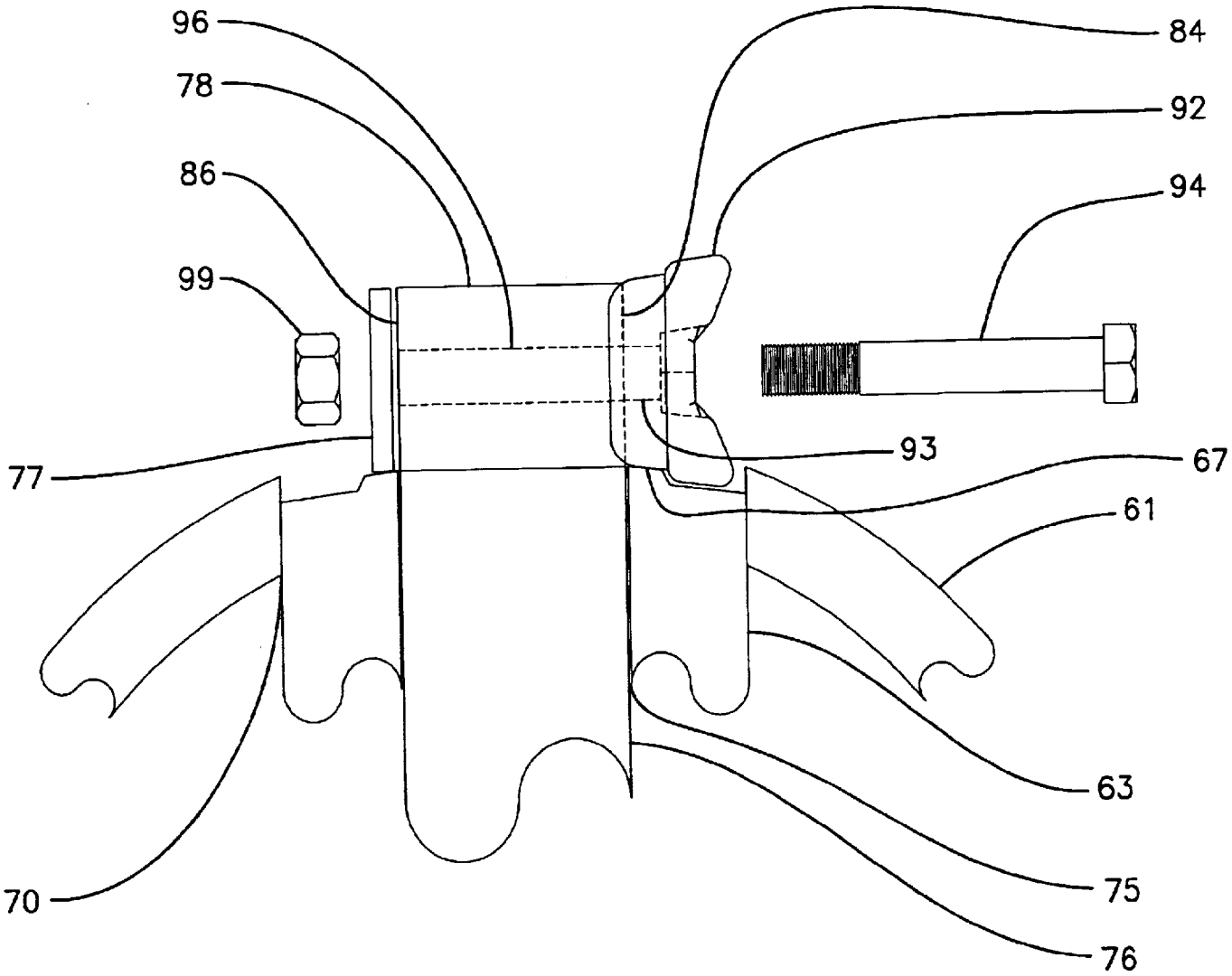
FIG. 10 is a side view of a connection configuration for securing a cutter to one of the hammers of the hammermill of FIGS. 5*a*–5*b;*

An alternate mounting arrangement for cutter 92 onto through-member 78 is illustrated in FIG. 10 wherein an additional backing plate 77 is added in the assembly. This additional backing plate is positioned to transfer a portion of the radial load on cutter 92 to the sleeve 63 through bolt 94. The backing plate 77 is removable and is fastened to through-member 78 by bolt 94.

This transfer of load, from a cutter to the sleeve 63 has been found to be sufficient to deform the end of sleeve 63. This deformation is detrimental to the subsequent removal of through-member 76. It has been found to be beneficial to manufacture the sleeves 63 from a material, which can be heat-treated to achieve material properties sufficient to resist such deformation. In a preferred embodiment the sleeves 63 are constructed from steel conforming to specifications of SAE 8620 carburized, quenched and tempered to a surface hardness of Rockwell C-Scale Hardness 40 with a case depth of 0.030 inches. The configuration of the sleeves 63, and the method of retaining them in the drum 61 is such that they are first processed to the correct shape, then they are heat treated such that selective portions of the surface, those that are adversely affected by the change in material characteristics, are not affected. This is accomplished by applying a masking compound, that prevents carbon migration during the carburization process, to those areas. In the preferred embodiment, those areas correspond to areas that will later be welded.

Alternate embodiments could include sleeves 63 that are not welded. In that case, the selective heat treating may not be necessary, and in fact a medium to high carbon steel, for instance, may be utilized. However, in all cases the material properties of the sleeves 63 will be selected to prevent deformation resulting from the radial loading.

The hammermill 56 also can include a rod 126 (best shown in FIG. 5*b*) that extends along the axis of rotation x—x as shown in FIG. 5*b*. The rod 126 extends through a longitudinal opening 122 defined by the non-driven shaft 130 and the first end cap 104. The rod 126 also extends through the plurality of co-axially aligned, central openings 125 defined by the through-members 76. The rod 126 also can include a threaded end that threads within an internally threaded opening 132 defined by the driven shaft 118. In this manner, the rod 126 could be used to clamp the end caps 104, 106 together. The rod 126 functions as a hammer retention system for the through-members 76 within the drum 61. A significant aspect of the invention is that a single retaining member (i.e., the rod 126) can be used to secure all of the through-members 76 to the drum 61.

Figure 11:
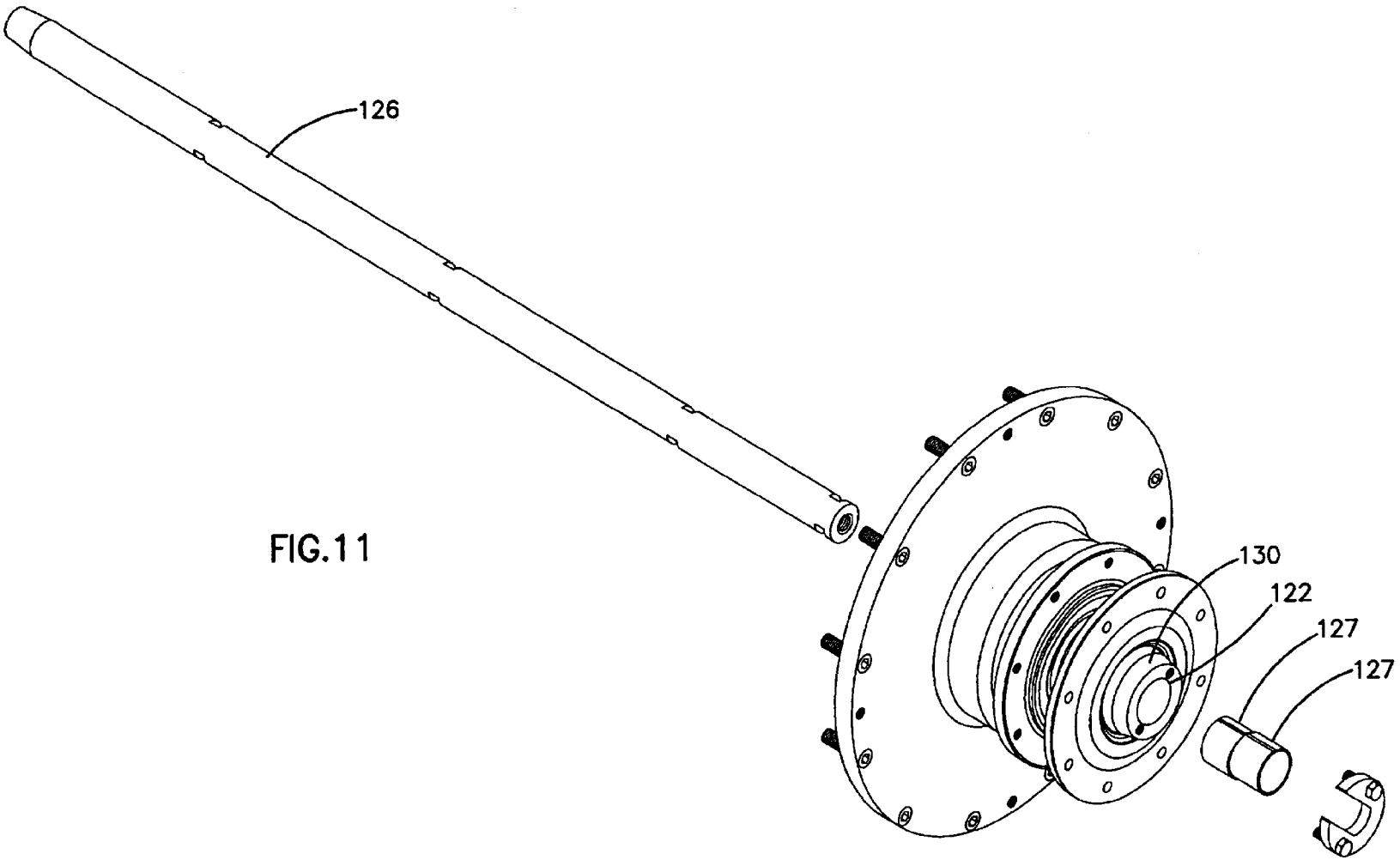
FIG. 11 shows a modified end plate design for the hammermill of FIG. 5A.

The through-members 76 can experience significant radial acceleration when a cutters is inadvertently lost. This loading is absorbed by the rod 126, performing its function of securing the through-member to the drum 61. It has been found that the rod 126 can be thus damaged, to the extent that the subsequent removal of the rod 126 by passing it through the opening 122 is made difficult. FIG. 11 illustrates the addition of 2 bushings 127 in the assembly. Bushings 127 are sized to fit into the opening 122 and have an ID large enough to allow rod 126, in its normal condition, to pass through. The bushings have an outer diameter slightly larger than the mating inner diameter which defines the opening 122. Thus, they are pressed into place and are retained in their original location. If a damaged rod 126 is removed, the damaged section of the rod is typically not able to pass through the inner diameter of the bushing 127. However, the press-fit bushing 127 is able to slide in opening 122 thus allowing the rod 126 to be removed.

In an alternative embodiment, the rod 126 can be used to retain shorter through-members (e.g., half the length of the through-members 76) that each extend through only one of the openings 70, 72. Also, the rod 126 need not be threaded into the driven shaft 118. For example, the rod 126 can be configured to thread within the longitudinal opening 122 of the non-driven shaft 130 (e.g., the rod 126 can have threads near its head). In such a configuration, the far end of the rod preferably fits within an unthreaded sleeve or opening defined by the driven shaft 118.

Figure 6:
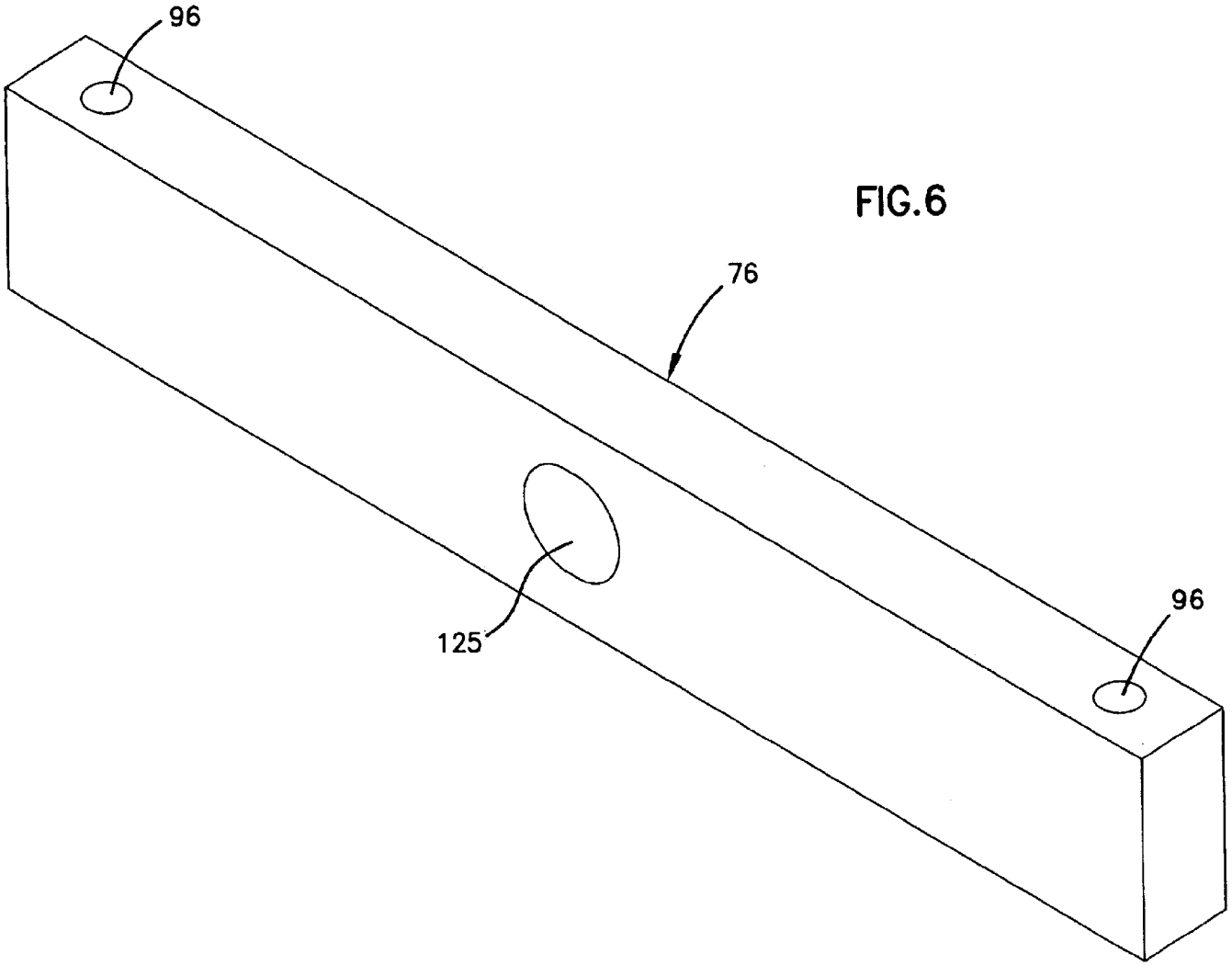
FIG. 6 is a perspective view of one of the duplex hammers of the hammermill of FIG. 5*a;*

FIG. 6 shows one of the through-members 76 in isolation from the drum 61. As shown in FIG. 6, the through-member 76 comprises a generally rectangular bar having the opening 125 defined at a central region of the bar, and the cutter mounting holes 96 defined at the ends of the bar. Of course, other shapes (e.g., octagonal, hexagonal, round with flats, etc.) could also be used.

Figure 7A:
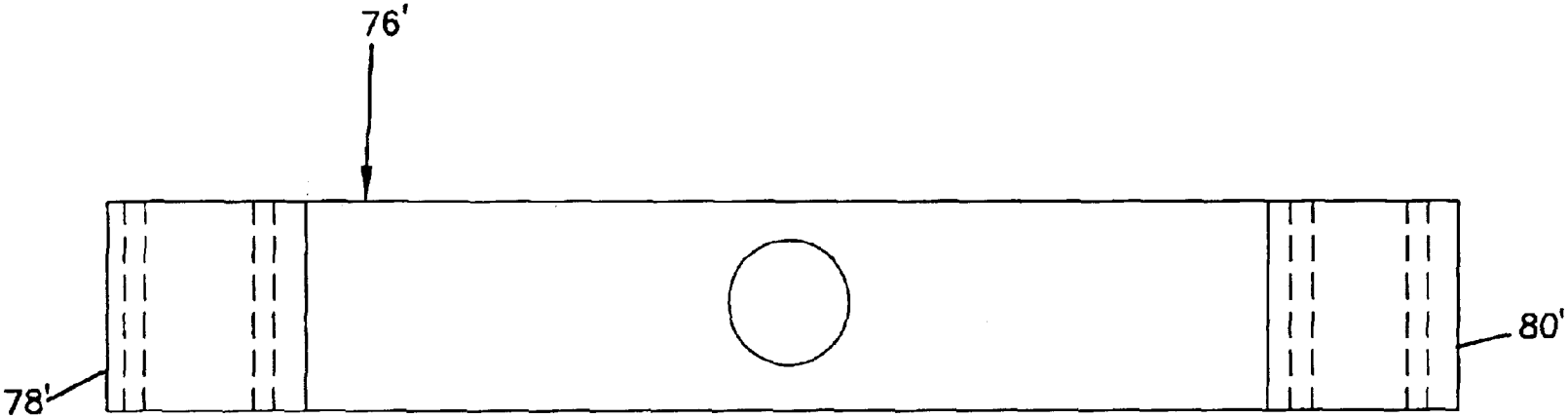
FIG. 7*a* is a side view of an alternative embodiment of a duplex hammer of the invention
Figure 7B:
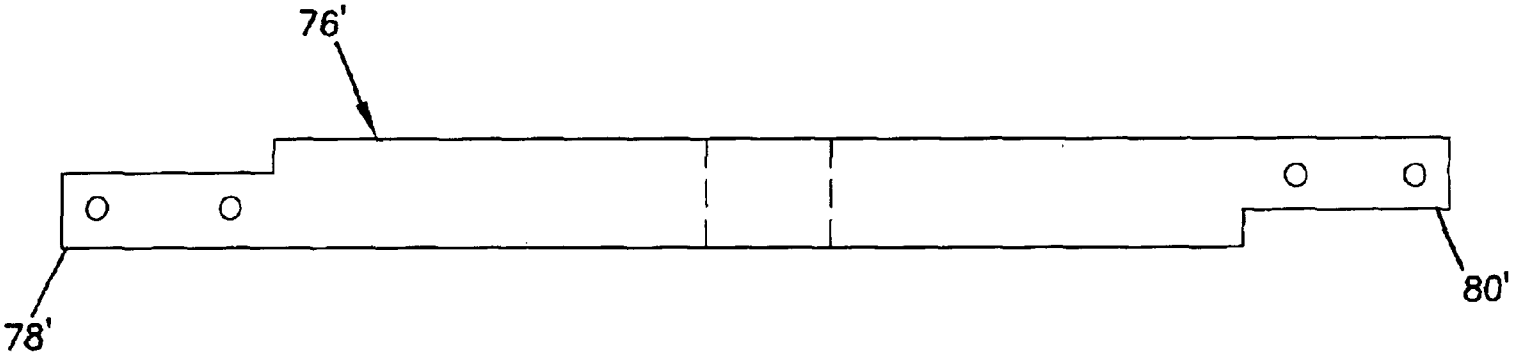
FIG. 7*b* is a side view of the alternative embodiment of the duplex hammer of FIG. 7*a* taken along a line perpendicular to the view of FIG. 7*a;*

FIGS. 7*a* and 7*b* show side views of an alternative embodiment of through-member 76' adapted to be mounted in the drum 61. The through-member 76' has first and second ends 78', 80' that are adapted for mounting narrow faced cutters used for more aggressive grinding of certain types of material.

Figure 8:
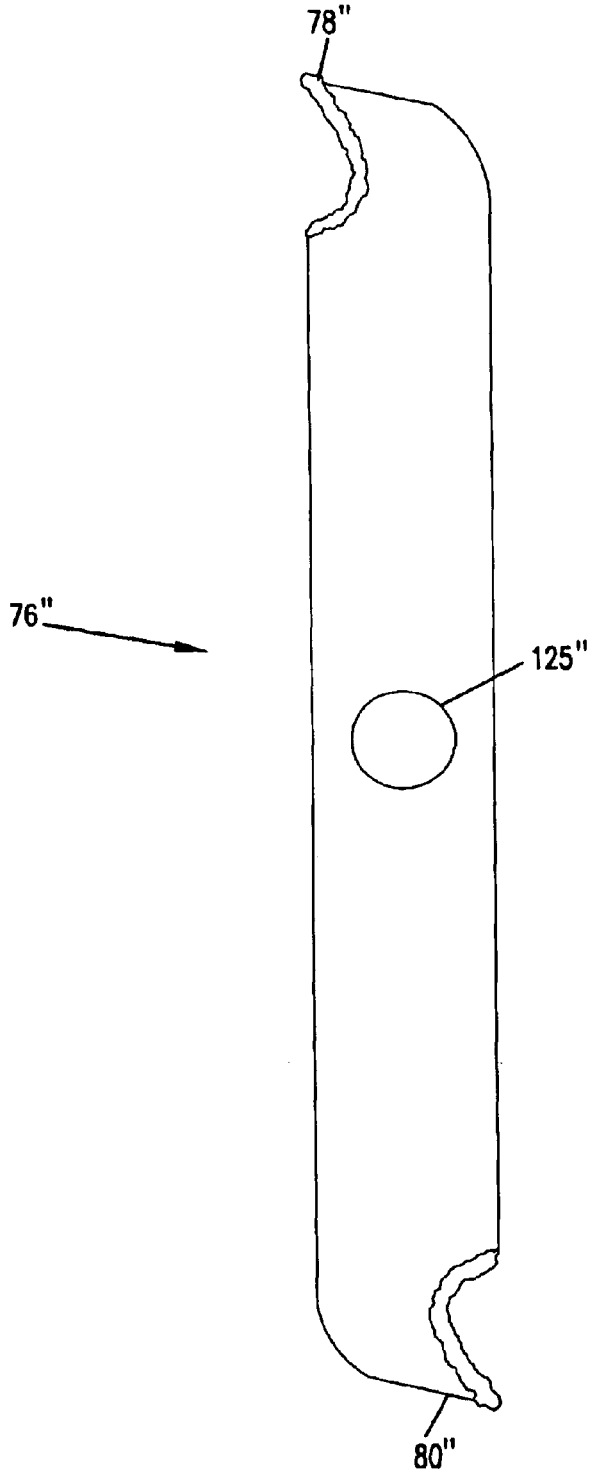
FIG. 8 shows another duplex hammer adapted for use with the hammermill of FIG. 5*a;*

FIG. 8 shows another through-member 76" adapted for use with the hammermill 56. The through-member 76" has hooked ends 78", 80" that form aggressive cutting teeth. Shims can be used at the sides of the through-member 76" to stabilize the through-member 76" within the openings 70, 72 of the drum 61. Hardfacing can be used at the hooked ends 78", 80" to improve durability. Additionally, the through-members 76" preferably include central openings 125" for allowing the through-members 76" to be connected to the drum 61 by a single retaining member (e.g., the rod 126) in the same manner described above with respect to the through-members 76.

Figure 9:
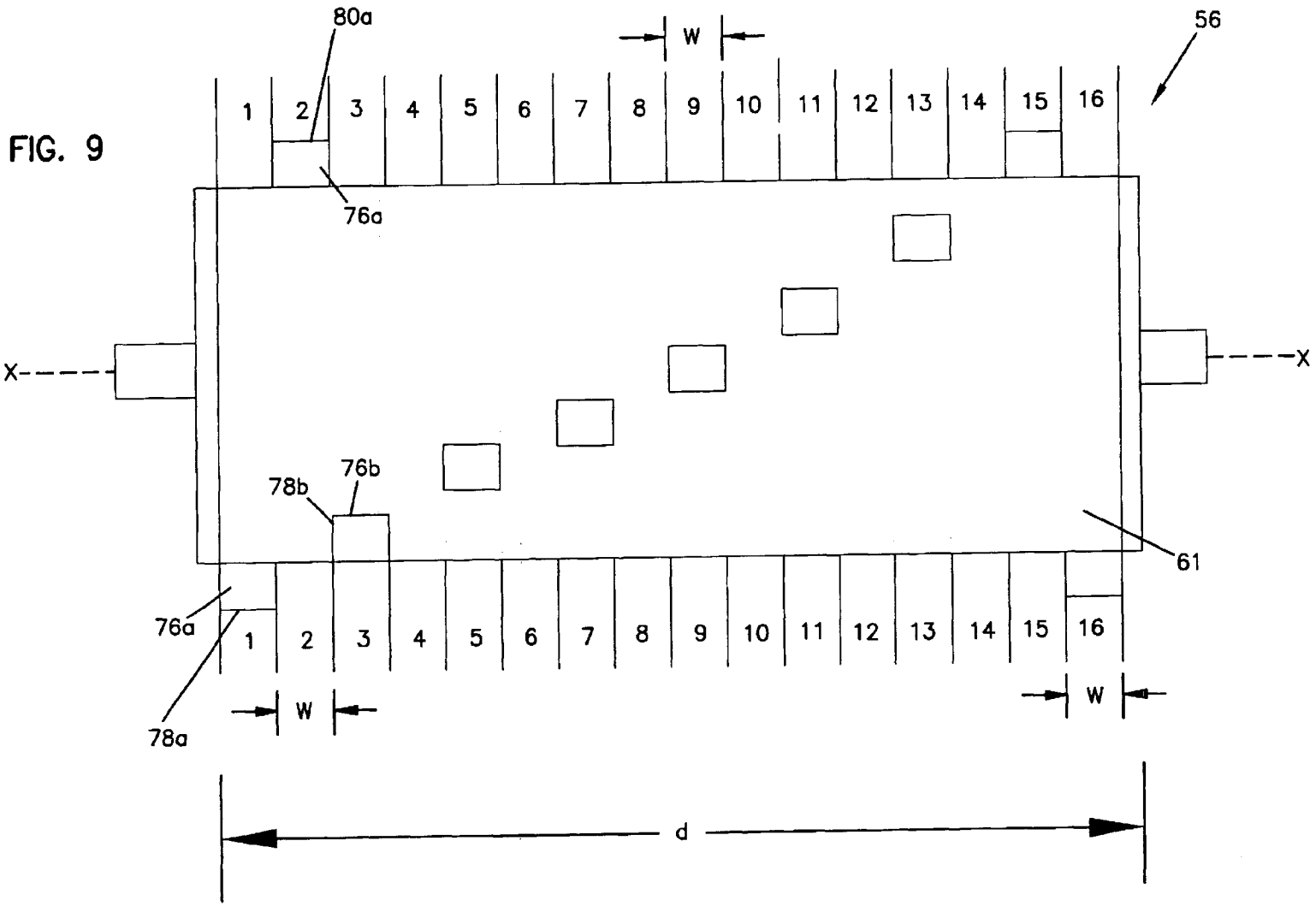
FIG. 9 is a schematic, elevational view of the hammermill of FIG. 5*a;*

FIGS. 5*a* and 5*b* show that the through-members 76 of the hammermill 56 are skewed relative to the axis of rotation x—x of the hammermill 56 (i.e., the through-members 76 intersect the axis x—x at an oblique angle). The angled nature of the through-members 76 relative to the axis x—x causes the first end 78 of each through-member 76 to travel along a different grinding path than the its corresponding second end 80. For example, as shown in FIG. 9, a first one of the through-members 76*a* has a first end 78*a* that travels along path 1, and a second end (80*a*) that travels along path 2. Similarly, a second one of the through-members 76*b* has a first end 78*b* that travels along path 3, and a second end (not shown) that travels along path 4. The remainder of the through-members are preferably arranged in a similar configuration. Hence, the 8 through-members provide 16 separate cutting paths spaced along the axis x—x of the drum 61 In certain embodiments, the hammers are adapted to provide full face coverage of the drum 61. Full face coverage means that there are no substantial gaps between adjacent cutting paths. Thus, as shown in FIG. 9, path 1 terminates where path 2 begins; path 2 terminates where path 3 begins; path 3 terminates where path 4 begins; etc. The skewed configuration of the through-members 76 allows full-face coverage to be provided with a relatively small number of through-members 76. The skewed configuration also allows hammers to be mounted directly at the far edges of the drum 61. While paths 1–16 are non-overlapping, it will be appreciated that alternative embodiments can have overlapping paths. Additionally, for certain applications, gaps can be provided between adjacent cutting paths.

Still referring to FIG. 9, each of the cutting paths 1–16 is typically defined by a maximum width of a cutter corresponding to each path. For example, paths 1 and 2 have widths w (measured in an axial direction) that correspond to the maximum widths of the cutters that are swung through the paths. For certain embodiments, the sum of the widths of all the paths is equal to or greater than a length d of the drum 61. As shown in FIG. 9, the sum of the widths equal the length d. However, if the paths overlap, the sum of the widths will be larger than the length d. By contrast, if gaps are provided between adjacent paths, the sum of the widths is less than the length d.

Figure 12:
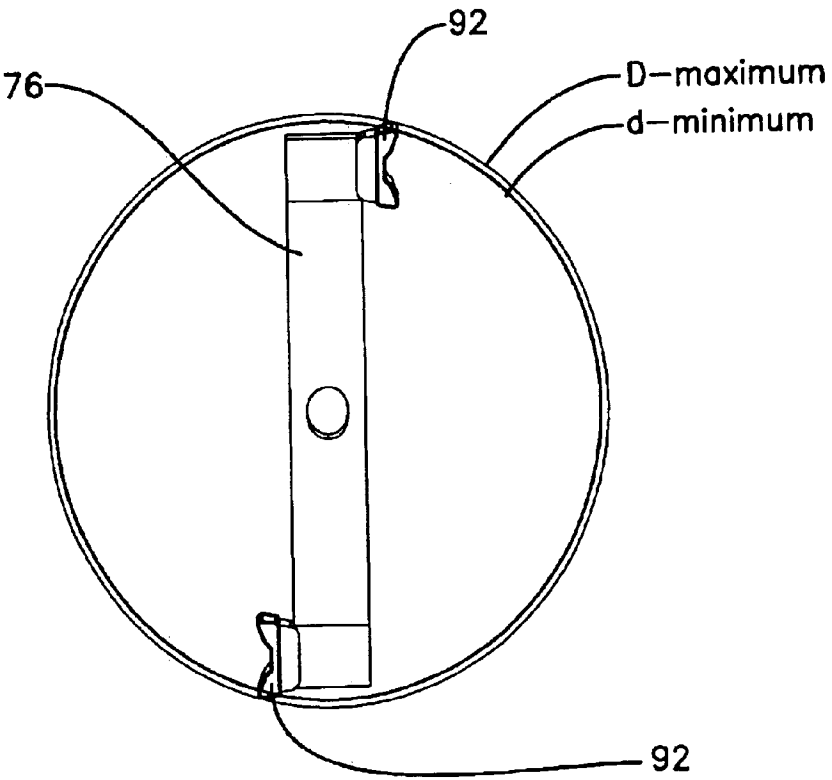
FIG. 12 is an end view showing maximum and minimum cutting diameters for a grinding member that is an embodiment of the present invention.
Figure 13:
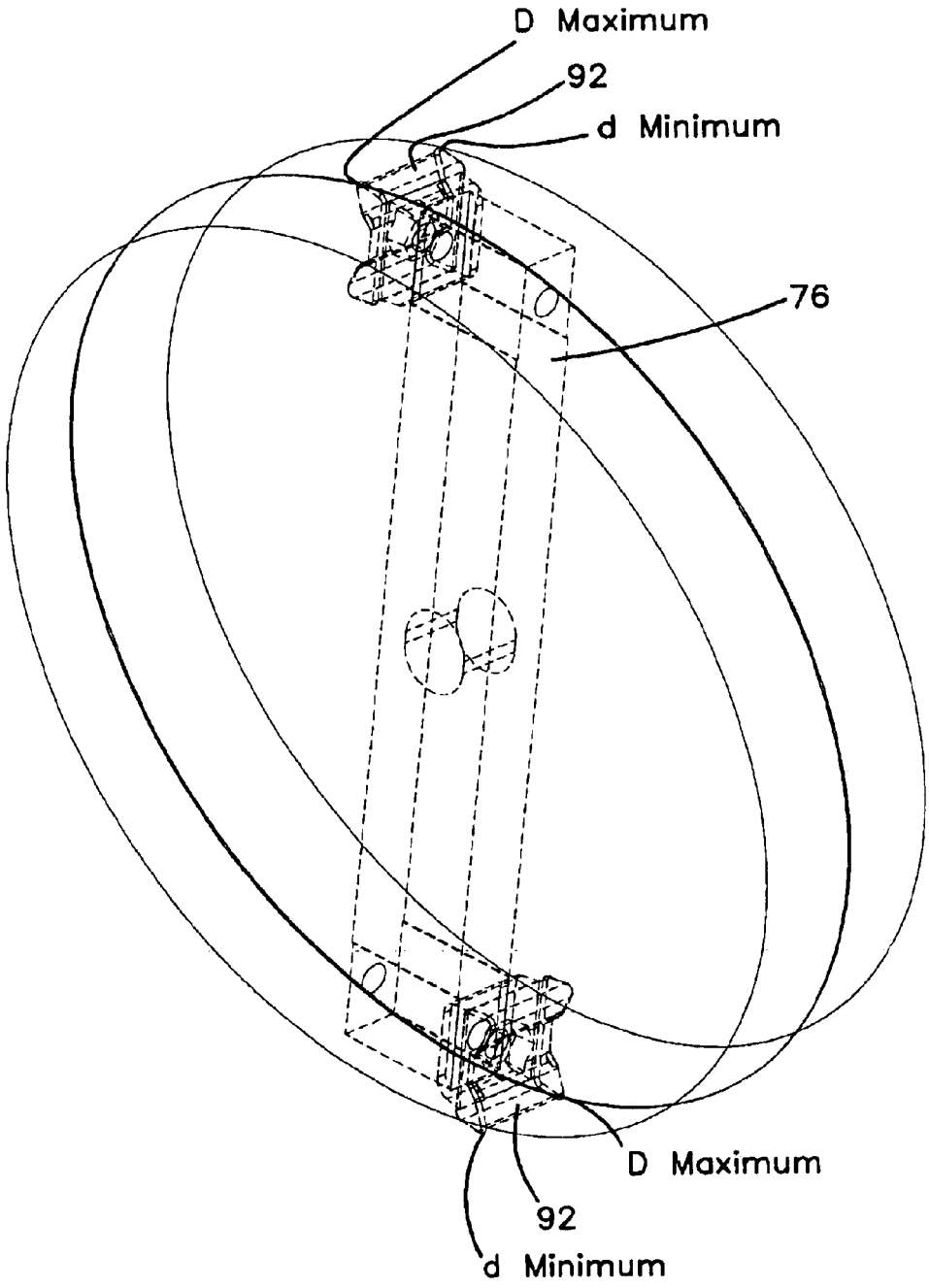
FIG. 13 is a perspective view showing the maximum and minimum cutting diameters of FIG. 12.
Figure 14:
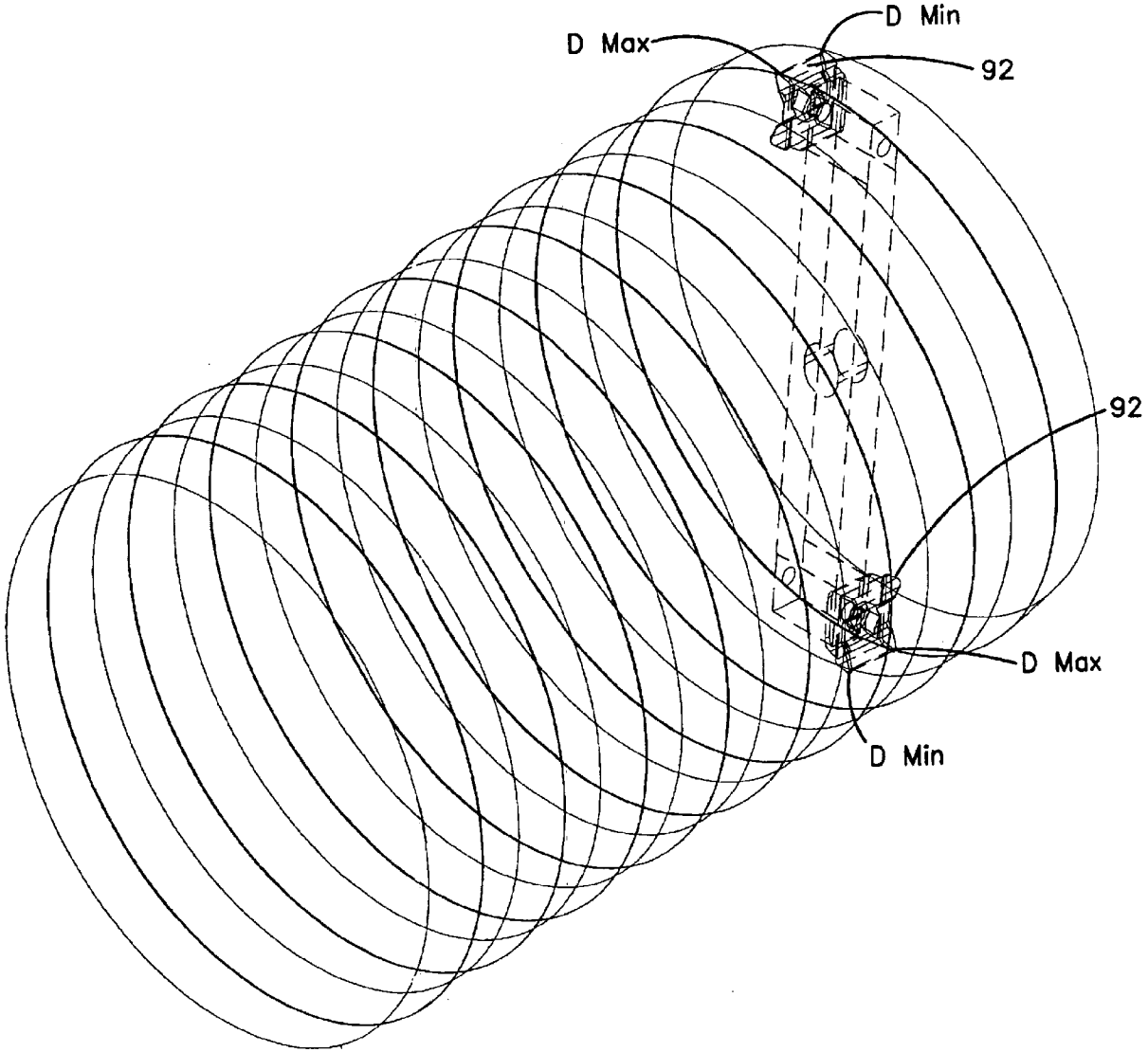
FIG. 14 is a perspective view showing the maximum and minimum cutting diameters for an entire hammermill.
Figure 15:
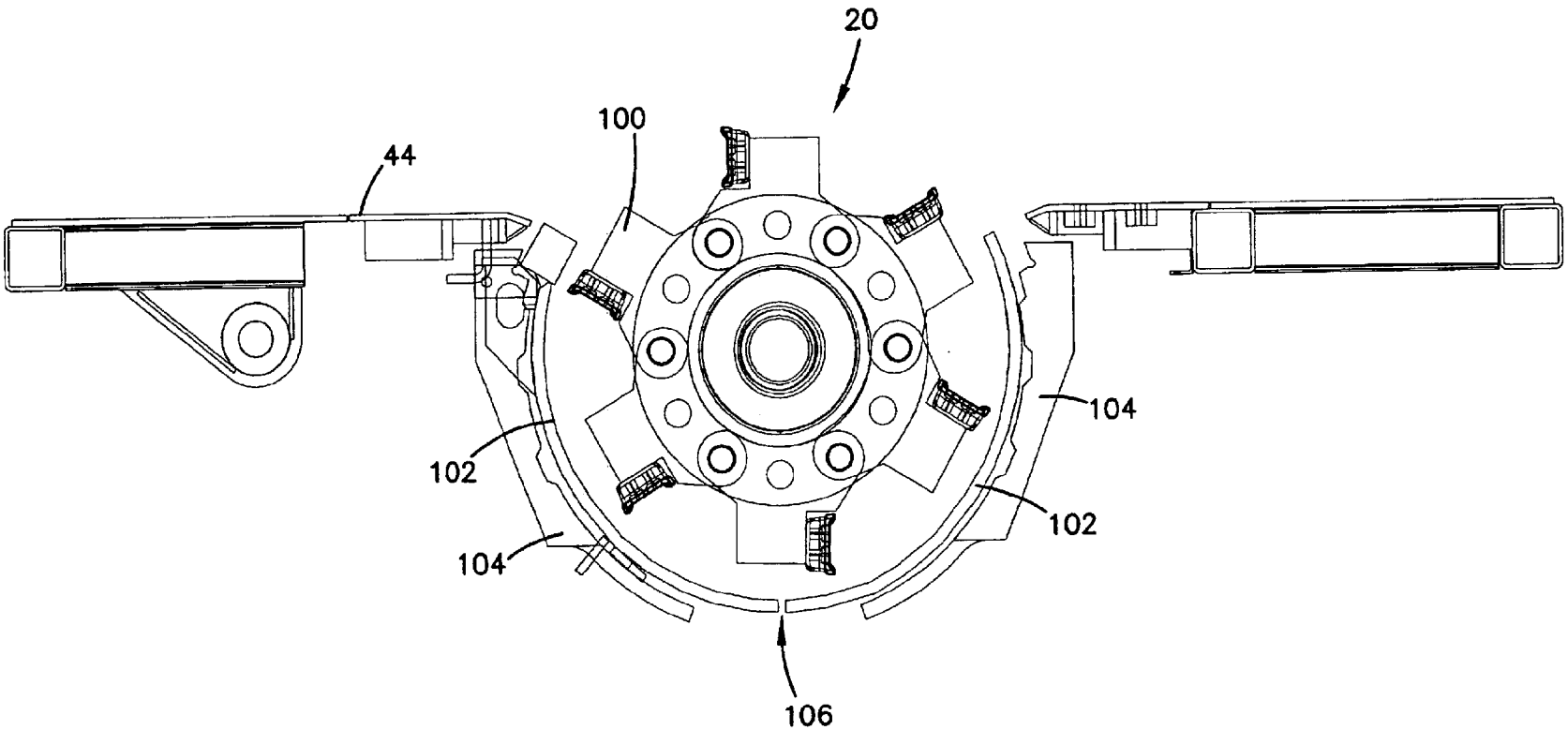
FIG.15 (Prior Art)
FIG. 15 is an end view of a prior art grinder.

FIGS. 12, 13 and 14 illustrate a representative surface of rotation defined by the cutting surface or edge of the generally block-shaped cutters 92, the edge located at the furthest radial dimension. This surface of rotation can be described as a series of aligned cones, with a varying effective cutting diameter for each cutter including a maximum diameter D-maximum and a minimum diameter d-minimum. FIG. 12 illustrates the position of cutters 92 on a through-member 76. Through-member 76 passes through 2 holes, 70 and 72, in drum 61 such that the through-member is angled relative to the horizontal axis x—x at an oblique angle θ (as shown in FIG. 4*b*). This angle results in the cutting edge of each cutter 92 being angled, thus defining the conical surface of rotation. FIG. 13 illustrates the resulting surfaces of rotation defined by a pair of generally block-shaped cutters 92 mounted onto a through-member 76. Locating several through-members on a common axis of rotation, will result in the overall surface of rotation of the entire hammer mill as illustrated in FIG. 14.

Figure 16:
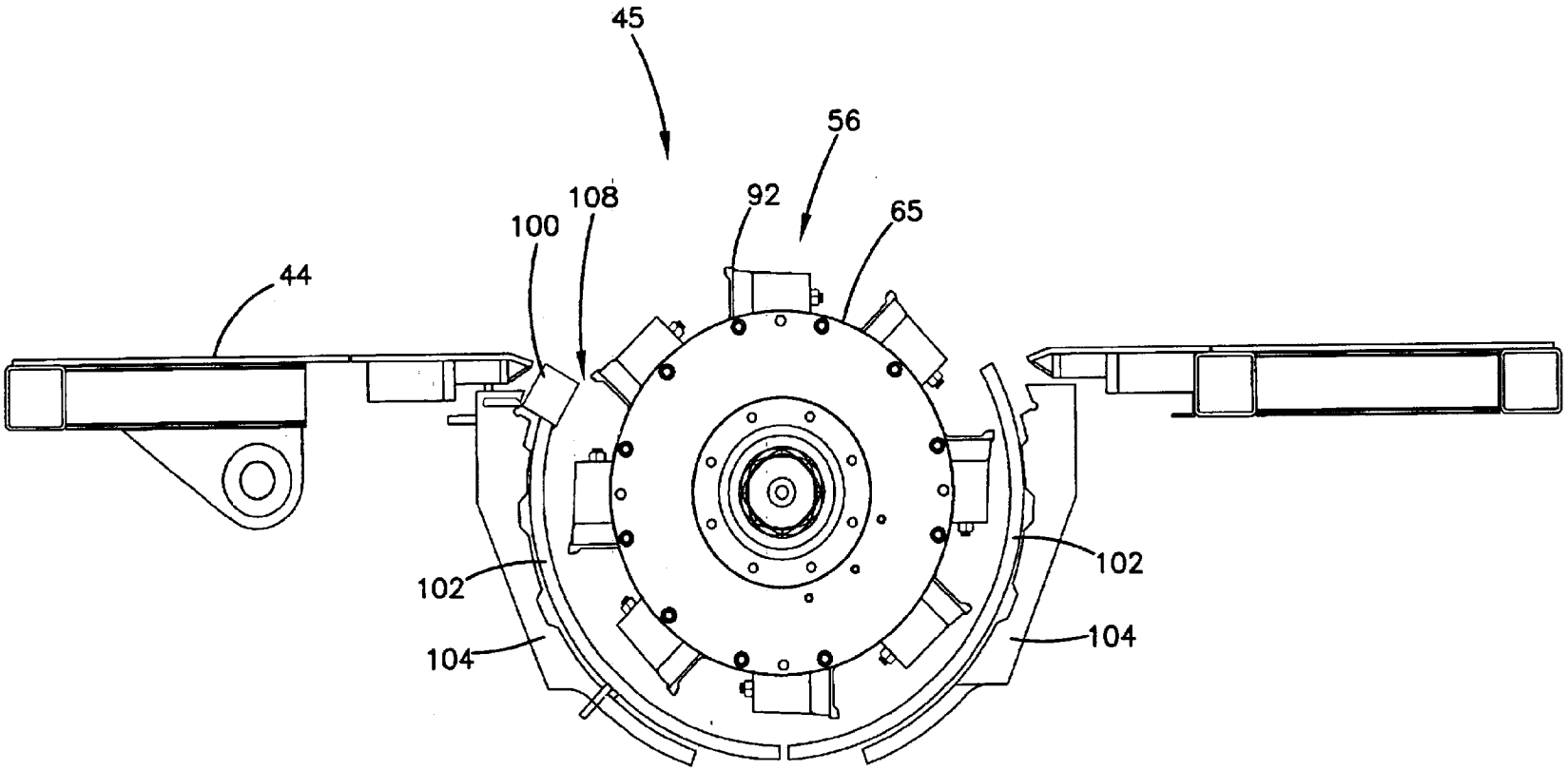
FIG. 16 is an end view of a grinder including a grinding device that is an embodiment of the present invention.

The rotary grinder 56 herein described can be used in a grinding device, as illustrated in FIG. 16, and will cooperate with the anvil and screens in much the same manner as the prior art rotary grinder 20. However, the grinding characteristics of the grinding device with rotary grinder 56 will be different than with rotary grinder 20. The differences are related to the fact that the surface of rotation of rotary grinder 56 is a series of aligned conical sections as opposed to the generally straight cylindrical surface of rotation. This fact will affect the grinding characteristics.

An additional difference between the rotary grinders is the presence of the cylindrical exterior surface 65. This surface holds the material to be ground forcing all the material to pass closely to the grinding chamber 108, previously defined as the space between the screen and the rotary grinder. In the prior art rotary grinder 20 material could travel between the rotor plates 24, and avoid being reduced in size. However, with rotary grinder 56 the cylindrical exterior surface 65 prevents this and thus is effective in improving the grinding characteristics of the grinding device.

While it is preferred to use a skewed through-hammer configuration to angle the cutters 92, the invention is not limited to this type of configuration. Instead, in other embodiments, more conventional type hammers can be modified so as to mount the cutters at an angle relative to the axis of rotation of the grinder.

Figure 17:
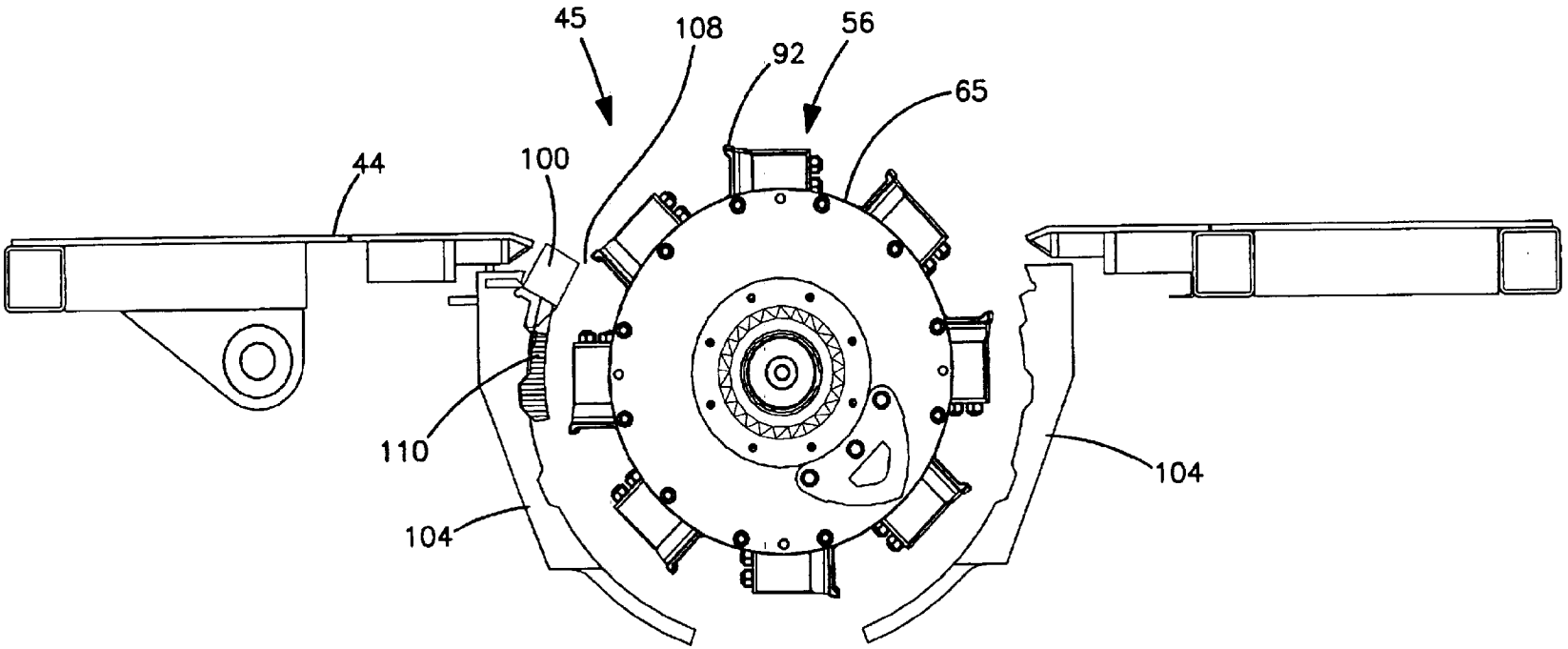
FIG. 17 shows the grinder of FIG. 16 with the end plate removed.

FIG. 17 illustrates a modified grinding device of the present invention comprising the rotary grinder 56, and only an anvil. In this embodiment the grinding action will take place exclusively between the anvil 100 and the rotary grinder 56, including its cylindrical exterior surface 65 and cutters 92. This embodiment will result in reduced load and power requirements.

Figure 18:
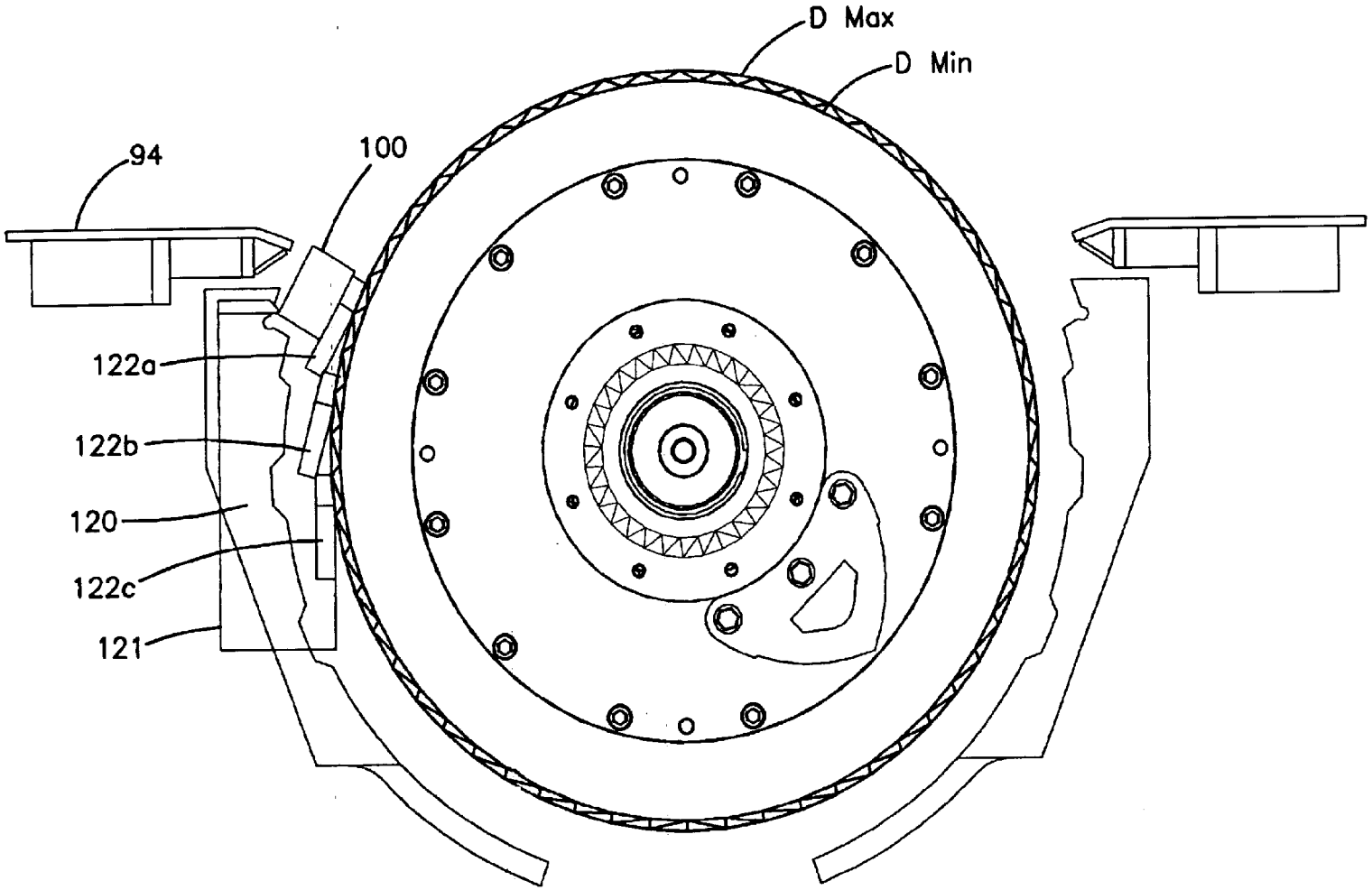
FIG. 18 shows a grinding device in accordance with the principles of the present invention that includes an enhanced sizing screen.
Figure 19:
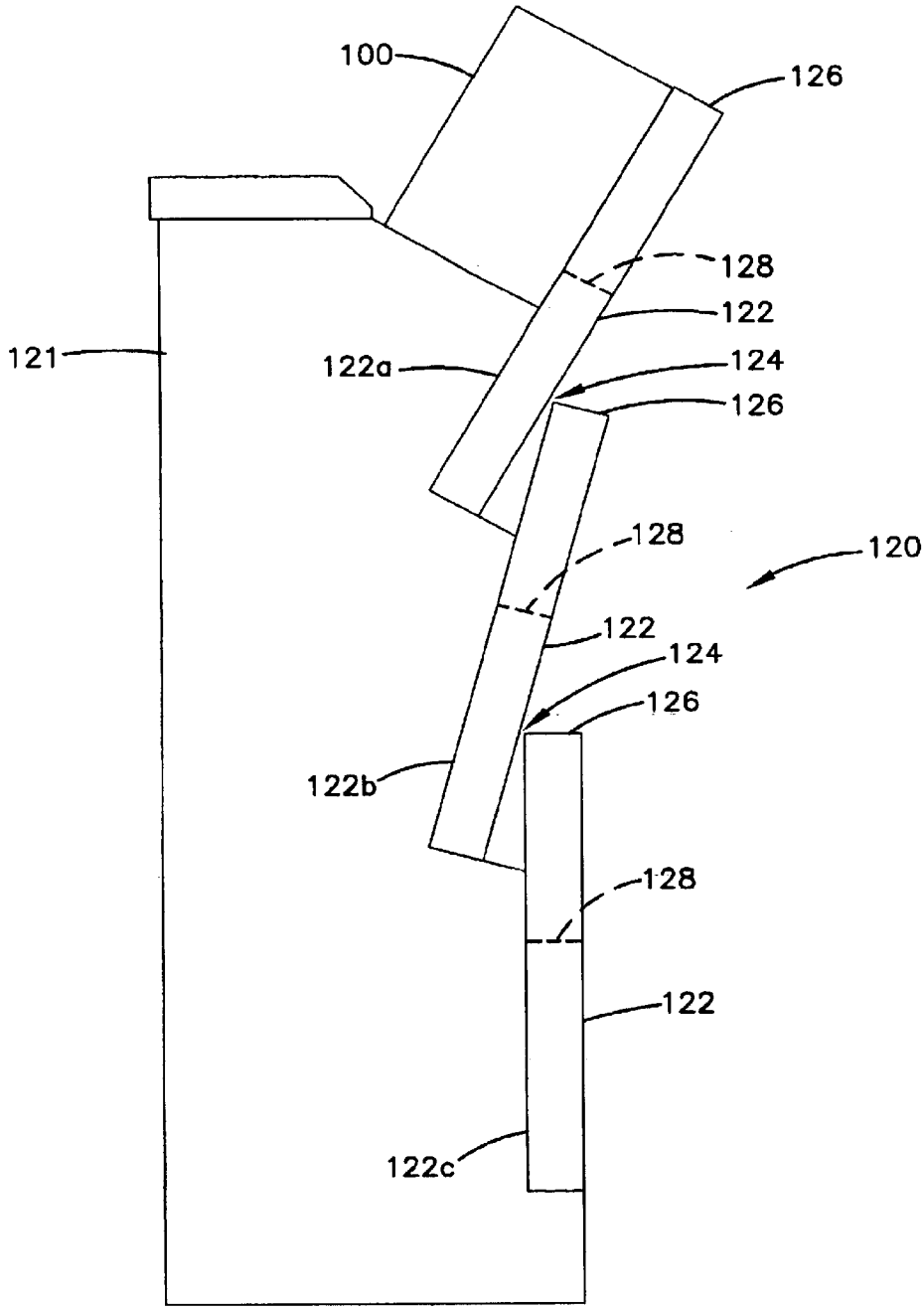
FIG. 19 is a side view of the sizing screen included with the grinding device of FIG. 18.
Figure 20:
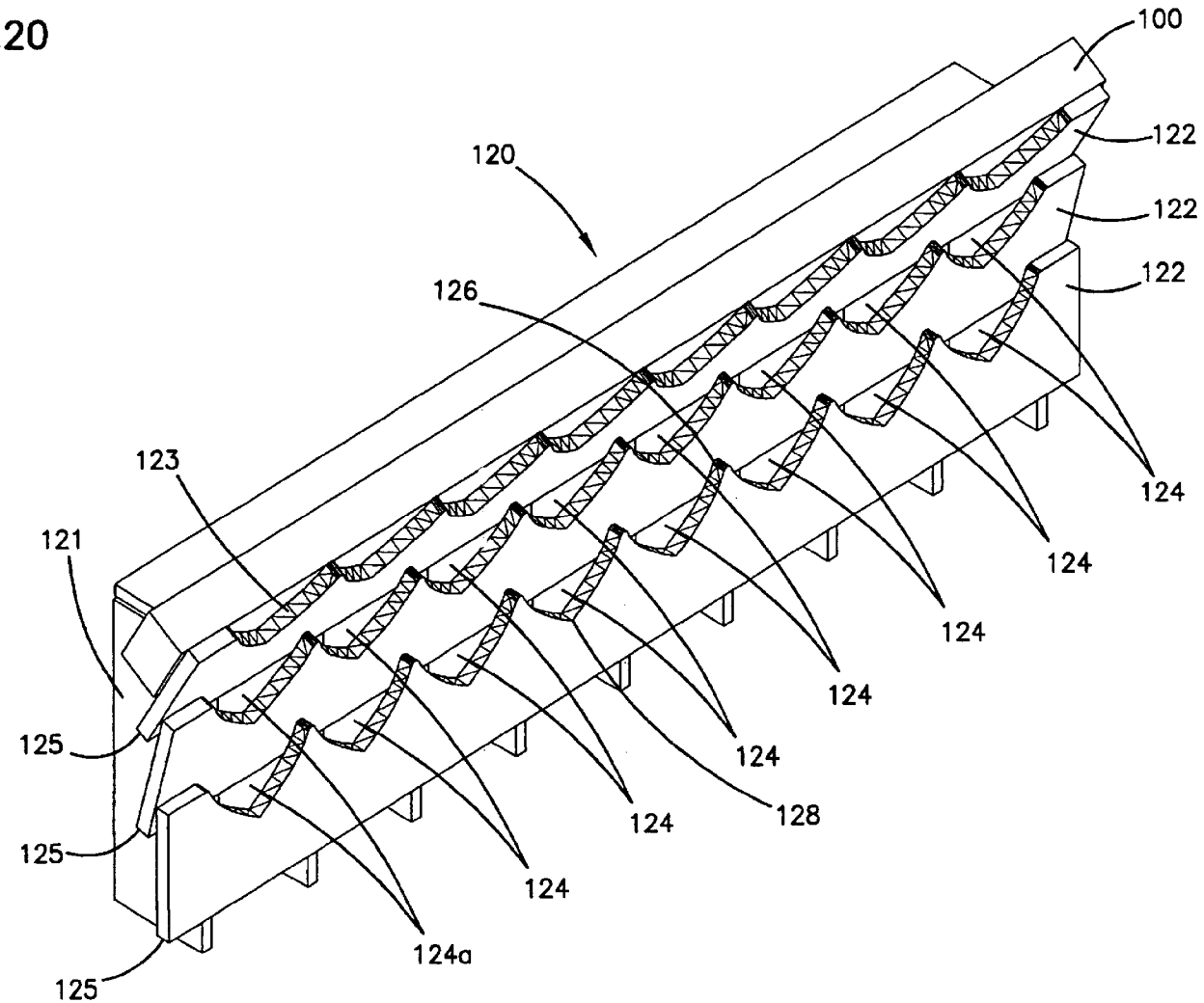
FIG. 20 is a perspective view of the sizing screen of FIG. 19.

Another embodiment of the present invention is illustrated in FIG. 18. In this embodiment the screen comprises improved screen 120. FIGS. 19 and 20 further illustrate the screen 120. In this embodiment screen 120 consists of a frame 121, anvil 100, and 3 scalloped screen plates 122. The scalloped screen plates 122 include an upper surface 123 that will serve as a shearing surface. This surface includes a series of tips 126 and valleys 128. The portion of the upper surface 123 between each tip 126 and valley 128 will be aligned with a surface of rotation of a cutter of the rotary grinder 56, as illustrated in FIG. 16. The surface of rotation of each cutter defines a D-maximum and d-minimum. In one embodiment, D-max of each cutter aligns generally with a valley 128 and D-min aligns generally with a tip 126. While the embodiment has been depicted including 3 screens, it will be appreciated that more or fewer screens could be used. Certain embodiments may include only one screen.

While the screen 120 is preferred to be used in combination with the depicted grinding drum, it will be appreciated that the screen is applicable to any type of grinding apparatus. For example, the screen is applicable to skewed and unskewed hammers. Also, the screen 120 could be used with grinding elements of the type disclosed in the background of the invention.

Figure 21:
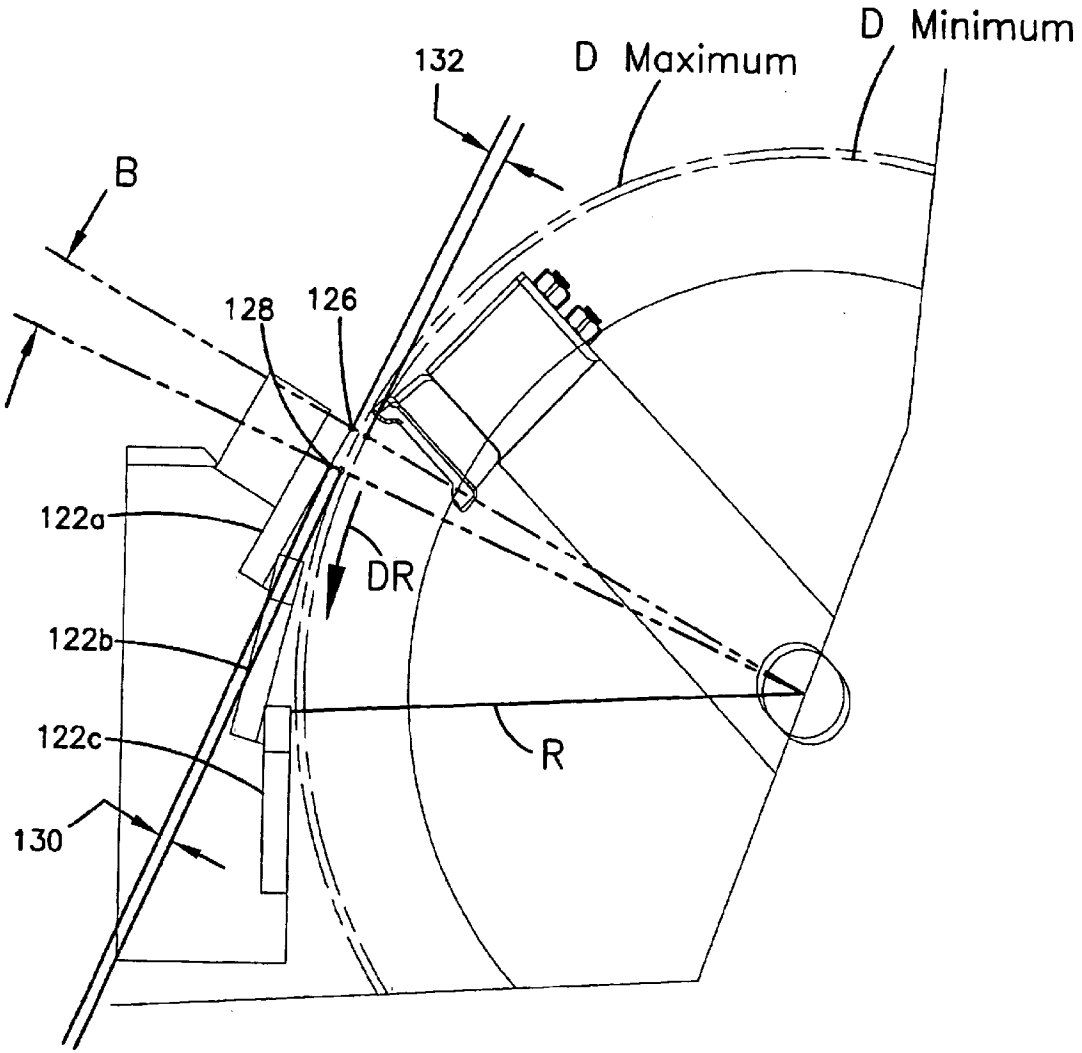
FIG. 21 shows the special relationship between the grinding members and the sizing screen of the grinding device of FIG. 18.

FIG. 21 illustrates how the screen 120 is aligned with rotary grinder 56. It is positioned such that there is a gap 130 between the minimum diameter d-minimum of each cutter and a tip 126 of the scalloped screen plate 122 and a gap 132 between the maximum diameter D-maximum of each cutter and a valley 128 of the scalloped screen plate 122. The gap between the portion of the upper surface 123 of the scalloped screen plate 122 between each tip 126 and valley 128 and the cutters is approximately consistent. In this manner the upper surface 123 of each scalloped screen plate 122 serves as a shearing surface.

The interaction between this shearing surface and the cutters provides a scissors effect wherein the shearing action happens over a significant range of travel of each cutter. FIG. 21 illustrates this range of travel as B. The resulting shearing action provides more consistent load requirement, while simultaneously providing increased shearing forces on the material being ground.

The surface 123 of the scalloped screen plates will be subjected to abrasive conditions. This surface can be manufactured with any known type of surface treatment to reduce wear and increase service life. Likewise some treatments such as carbide impregnated weld, will increase the aggressiveness of the surface resulting in more effective grinding.

FIG. 20 illustrates an additional feature of the scalloped screen plate 122, its bottom surface 125. This bottom surface 125 can be straight or contoured. If it is straight it will cooperate with the top surface of associated scalloped screen plates 122 to form approximately triangular shaped openings 124. If it is contoured the openings will be more restricted as illustrated by openings 124*a*. These openings 124 or 124*a* will function to allow ground material, of a certain size, to pass through and exit the grinding device.

Referring to FIG. 21, the plates 122 include plates 122*a*, 122*b* and 122*c* that overlap one another. The plates 122*a*, 122*b* and 122*c* are progressively angled toward vertical. For example, plate 122*a* defines a greater angle relative to vertical than plate 122*b*, and plate 122*b* defines a greater angle relative to vertical than plate 122*c*. Plate 122*c* is aligned substantially upright.

In a preferred embodiment, the plates 122 are oriented such that leading portions of the plates 122 are "generally perpendicular" (perpendicular plus or minus 30 degrees) relative to a radius of the rotary grinder that intersects the leading portions. For example, referring to FIG. 21, radius R is generally perpendicular to the leading portion of plate 122*c*. In this embodiment, the tips 126 (i.e., teeth) of the plates 122 extend outwardly from the plates in a direction opposite to the direction of rotation DR of the grinder. In other words, the valleys 128 face toward the direction of rotation DR of the grinder. The phrase "leading portion" will be understood to mean the portion of each plate which is first passed by the cutters as the grinder rotates (e.g., the upper portions in the depicted embodiment).

Referring still to FIG. 21, the plates are shown generally tangent to D-maximum of the rotary grinder. In other embodiments, D-maximum can intersect (i.e., overlap) the plates 122 such that portions of the cutters 92 pass through the valleys 128 between the peaks 126. Of course, the spacing between the hammers and the screen can be varied depending upon the material being processed and the size of the end product desired. In certain embodiments, a gap can exist between the screen and the cutters such that the paths of the cutters do not intersect the valleys.

The method of replacing parts for the rotary grinder of this invention will now be explained. These various methods include replacement of cutters, replacement of through-members, and replacement of drums. These methods are all made easier in this invention.

The cutters can be easily reversed or replaced by removing the bolt 94. The old cutter 92 is removed and a new cutter 92 or a different type cutter is fastened to the through-member 76 with bolt 94.

One of the through-members 76 can be individually replaced by removing at least one of the cutters 92 from the through-member 76 desired to be replaced. The rod 126 is then removed from the hole in the driven shaft 118 and removed from the holes 125 of the through-members 76 by sliding the rod 126 at least partially out of the drum 61. The bushings 127 may need to be removed if the rod 126 has been damaged sufficiently to prevent it from sliding through the inner diameter of the bushing 127. The through-member 76 to be replaced can then easily be slid out of the drum 61. A new through-member 76 is then slid into the position previously occupied by the old through-member 76. Next, the rod 126 is slid back through the holes 125 and is inserted into the hole 132 in the driven shaft 118. Lastly, cutters 92 are secured to the ends of the new through-member 76. An important advantage of the through-members 76 is that when each through-member 76 is removed, equal weights are concurrently removed from opposite sides of the drum 61. Thus, during removal of the through-members 76, there are no unbalanced forces that cause the drum 61 to inadvertently rotate. Instead, the drum 61 remains balanced at all times.

During use of the hammermill 56, the leading faces 84, 88 of the through-members 76 can become worn or deformed such that flat surfaces are no longer provided for mounting the cutters 92. If this happens to a particular through-member 76, the through-member 76 can be removed by detaching the cutter 92 from the damaged end of the through-member 76, and by sliding the through-member 76 from the drum 61. Thereafter, the through-member 76 can be reversely mounted in the drum 61 such that the previous trailing faces 86, 90 of the through-member 76 become the leading faces 84, 88. Once the through-member 76 has been re-inserted through the drum, the cutter 92 can be fastened to the new leading face 84, 88 (i.e., the face that was the trailing face before the through-member 76 was reversed).

The following steps outline the method for replacing the drum 61. The drum 61 can be replaced along with the through-members 76 and cutters 92. Alternatively, the drum 61 can be replaced alone, while keeping the old through-members 76 and cutters 92. To replace the drum 61 along with the through-members 76 and cutters 92, first remove the rod 126 as described above. Next, remove the first and second end caps 104, 106 by removing bolts 116. The old drum 61 along with its associated through-members 76 and cutters 92 can then be discarded, and the end caps 104, 106 can be mounted on a new drum 61 with new through-members 76 and cutters 92. Lastly, the rod 126 is mounted axially through the new drum.

The following method can be used when replacing the drum alone while keeping the old through-members 76 and cutters 92. First, the rod 126 and the through-members 76 are removed. In removing the through-members 76, at least one of the cutters 92 will be removed from each of the through-members 76 to allow the through-members 76 to be pulled from the drum 61. Next, the end caps 104, 106 are removed as described above. Subsequently, the old drum 61 is removed and replaced with a new drum 61. Finally, the hammermill is reassembled in reverse order to the disassembly described above.

If through-members 76" are used with the drum 61, it will be appreciated that some or all of the through-members 76" may fall from the drum 61 when the rod 126 is removed. This occurs because the through-members 76" do not have cutters for maintaining alignment with the rod 126. Thus, during disassembly of the grinder, such through-members 76" will typically be removed from the drum 61 in concert with the removal of the rod 126.

With use, contact between the through-members 76 and the trailing shoulders of the sleeves 63 can cause the shoulders to deform or "mushroom." When this occurs, the end caps 104, 106 can be removed as described above, and the drum 61 can be reversed end-to-end. Thereafter, the through-members 76 can be reversed such that the cutters 92 face in the appropriate direction. By reversing the drum 61, the useful life of the drum can be increased.

With regard to the forgoing description, it is to be understood that changes may be made in detail, especially in matters of the construction materials employed and the size, shape and arrangement of the parts without departing from the scope of the present invention. For example, while the various aspects of the present invention are particularly applicable to hammermills, such aspects are also applicable to other types of rotary grinders that use hammers such as mining equipment, brush chippers, excavation equipment, concrete cutters, etc. As used herein, the term "grind" is intended to include terms such as chop, cut, crush, pulverize, etc. It is intended that these specific and depicted aspects be considered exemplary only, with a true scope and spirit of the invention be indicated by the broad meaning of the following claims.

What is claimed is:

1. A rotary grinder comprising:

a cylindrical, hollow drum having an exterior surface and an interior surface, the drum being rotatable about a longitudinal axis of the drum and the drum defining a plurality of openings that extend through the drum between the interior and exterior surfaces;

a plurality of through-structures that pass through the cylindrical drum, each through-structure including a first end positioned opposite from a second end, the through-structures including grinding portions positioned at the first and second ends of each through-structure, the grinding portions being located outside the cylindrical drum; and guides that extend radially within the drum between the openings of the drum, the guides being connected to the drum and being configured to receive the through-structures.

2. The rotary grinder of claim 1, wherein each of the through structures includes an aperture located between the first and second ends of the through structure, and positioned inside of the drum when the through structure is so installed, the aperture being adapted to receive a retention pin.

3. The rotary grinder of claim 2 wherein the each of the ends of the through structures are adapted to receive a cutter, the cutters defining the grinding portions of the through structures.

4. The rotary grinder of claim 3 wherein the ends are adapted to receive the cutters in a manner that when the cutters are mounted onto the through structures, the through structures are retained in the drum.

5. The rotary grinder of claim 2 wherein the through structures are constructed from a medium to high carbon steel.

6. The rotary grinder of claim 5 wherein the through structures are constructed from SAE 4140 that is through hardened to a surface harness of Rc 32 minimum.

7. The rotary grinder of claim 2 wherein the through structures are reversibly mounted in the drum so that both the first and second ends of the through structures have a leading and trailing face, depending on the orientation in which they are installed in the drum.

8. The grinder of claim 1, wherein the guides comprise sleeves.

9. A duplex hammer for use in a drum of a grinder comprising:

a bar having a first end, a second end, and an aperture located between the first and second ends, the bar being configured to removeably mount to the drum such that the first and second ends are positioned outside of the drum;

wherein the aperture is configured to receive a retention pin coaxially aligned with an axis of rotation of the drum, and the first and second ends include cutting surfaces.

10. The duplex hammer of claim 9 wherein the cutting surfaces of the first and second ends of the bar include removeable cutting surfaces mounted at the first and second ends of the bar.

11. The duplex hammer of claim 10 wherein the removeable cutting surfaces retain the first and second ends in the position outside of the drum when mounted to the first and second ends of the bar.

* * * * *